US009022817B2

(12) United States Patent
Endo et al.

(10) Patent No.: US 9,022,817 B2
(45) Date of Patent: May 5, 2015

(54) CONNECTOR TERMINAL INCLUDING LIMITER EXTENDING ALONG FIRST AND SECOND SPRING TERMINALS

(71) Applicant: Dai-Ichi Seiko Co., Ltd., Kyoto (JP)

(72) Inventors: Takayoshi Endo, Shizuoka (JP); Sakai Yagi, Shizuoka (JP); Masaya Muta, Shizuoka (JP); Shunya Oohashi, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 18 days.

(21) Appl. No.: 14/013,521

(22) Filed: Aug. 29, 2013

(65) Prior Publication Data

US 2014/0065898 A1 Mar. 6, 2014

(30) Foreign Application Priority Data

Sep. 3, 2012 (JP) ..... 2012-193393

(51) Int. Cl.

| | |
|---|---|
| ***H01R 11/22*** | (2006.01) |
| ***H01R 13/11*** | (2006.01) |
| ***H01R 43/16*** | (2006.01) |
| *H01R 12/91* | (2011.01) |

(52) U.S. Cl.

CPC ..... *H01R 13/112* (2013.01); *H01R 12/91* (2013.01); *H01R 13/114* (2013.01); *H01R 43/16* (2013.01)

(58) Field of Classification Search

USPC ..... 439/889, 74, 230, 861, 862, 939, 682, 439/249, 246, 326, 857

See application file for complete search history.

(56) References Cited

U.S. PATENT DOCUMENTS

| | | | | |
|---|---|---|---|---|
| 4,408,824 | A * | 10/1983 | Weidler | 439/398 |
| 5,207,598 | A * | 5/1993 | Yamada et al. | 439/636 |
| 5,924,883 | A | 7/1999 | Yamagami et al. | |
| 7,320,621 | B2 | 1/2008 | Laurx et al. | |
| 7,322,856 | B2 | 1/2008 | Laurx et al. | |
| 7,338,321 | B2 | 3/2008 | Laurx | |
| 7,344,386 | B2 * | 3/2008 | Michida | 439/74 |
| 7,553,190 | B2 | 6/2009 | Laurx et al. | |
| 7,621,779 | B2 | 11/2009 | Laurx et al. | |
| 2008/0146088 | A1 | 6/2008 | Ader | |

FOREIGN PATENT DOCUMENTS

| | | |
|---|---|---|
| JP | 1986-33377 | 2/1986 |
| JP | 09-148011 | 6/1997 |
| JP | 2009-140678 | 6/2009 |
| JP | 2012-3924 | 1/2012 |
| WO | 2006/105484 | 10/2006 |

OTHER PUBLICATIONS

European Search Report issued Oct. 30, 2013 in a corresponding European application. No. 13180848.7-1801.

* cited by examiner

*Primary Examiner* — Abdullah Riyami
*Assistant Examiner* — Nelson R Burgos-Guntin
(74) *Attorney, Agent, or Firm* — Wenderoth, Lind & Ponack, L.L.P.

(57) ABSTRACT

A connector terminal includes first and second spring terminals between which a male connector terminal of a male electric connector is sandwiched. The connector terminal is formed by bending a strip-shaped plate about lines intersecting with a longitudinal line of the plate such that a width of the plate is maintained as it is. The first and second spring terminals are formed with a limiter for preventing the first and second spring terminals from being outwardly deflected.

9 Claims, 24 Drawing Sheets

PRIOR ART

CONNECTOR TERMINAL INCLUDING LIMITER EXTENDING ALONG FIRST AND SECOND SPRING TERMINALS

BACKGROUND OF THE INVENTION

1. Field of the Invention

The invention relates to a connector terminal into which a male connector terminal of a male electric connector is inserted.

2. Description of the Related Art

For instance, Japanese Patent Application Publication Nos. 2009-140678 and 2012-3924 have suggested a connector terminal into which a male connector terminal of a male electric connector is inserted.

FIG. 17A is a perspective view of the connector terminal 1A suggested in Japanese Patent Application Publication No. 2009-140678, and FIG. 17B is a side view of the same.

The connector terminal 1A illustrated in FIGS. 17A and 17B is formed by punching an electrically conductive metal plate into a predetermined shape, and bending the plate to the illustrated shape.

The connector terminal 1A has a bottom surface 2 in the form of a flat strip and extending in an axial direction (Z direction). The bottom surface 2 is formed at a front thereof with a female contact 3 into which a male contact (not illustrated) is inserted. The female contact 3 is in the form of a box, and is rectangularly open at opposite ends thereof.

The female contact 3 is formed inside with a resilient contact or a spring 4 making resilient contact with the male contact. The female contact 3 is formed at opposite sidewalls thereof with guide projections 5 each outwardly extending.

FIG. 18 is a partially cross-sectional view of the connector terminal suggested in Japanese Patent Application Publication No. 2012-3924.

The illustrated connector terminal 1B is formed by pressing an electrically conductive metal plate. As illustrated in FIG. 18, the connector terminal 1B includes a terminal contact portion 11 with which a male contact (not illustrated) makes contact, a resiliently deformable portion 17 for relaxing a tension force, and a contact 22 with which a printed circuit board (not illustrated) makes contact.

The terminal contact portion 11 has a rectangular cross-section, and is open at opposite ends thereof. The terminal contact portion 11 is formed at an upper surface thereof with a resilient contact piece 12. When a male terminal is inserted into the terminal contact portion 11 through a front thereof, the male terminal is resiliently sandwiched between the resilient contact piece 12 and a bottom of the terminal contact portion 11. Thus, the male terminal makes electric contact with the terminal contact portion 11.

The terminal contact portion 11 is formed at an upper surface thereof with a metal lance 13 making engagement with a housing (not illustrated) when the connector terminal is inserted into the housing. The metal lance 13 is designed to be fixed at one end and to be free at the other end, and has a bent portion 14 between the opposite ends thereof.

In the conventional connector terminals illustrated in FIGS. 17A, 17B and 18, since a male connector terminal makes contact with and compresses the spring portion (that is, the spring 4 and the resilient contact piece 12), the male connector terminal exerts such a tension force on the spring portion that the spring portion is caused to be outwardly deformed. However, since the female contact 3 is designed to be in the form of a box and the spring 4 is connected at a proximal end thereof with the female contact 3, and since the terminal contact portion 11 is designed to be cylindrical, and the resilient contact piece 12 is connected at a proximal end thereof to the terminal contact portion 11, the spring portion is not excessively outwardly deformed together with the female contact 3 or the terminal contact portion 11. Hence, a contact pressure which the connector terminal exerts on the male connector terminals is not reduced. Thus, the box-shaped connector terminal ensures high reliability to electrical connection between itself and a male connector terminal.

As mentioned above, the connector terminal is formed by punching a metal plate, and bending the same. Specifically, a metal plate is punched into a shape having a strip called a carrier, and a plurality of connector terminals in a developed condition, the developed connector terminals being connected in a line to the carrier in a length-wise direction of the carrier. Then, each of the developed connector terminals is bent to thereby form a plurality of the connector terminals still connected to the carrier.

By forming a plurality of the connector terminals in the above-mentioned way, it is possible to insert a plurality of the connector terminals arranged in a line along the carrier, into terminals storage rooms of a housing as they are in a single step.

However, if a terminal main body of a connector terminal formed by punching a metal plate and being bent were in the form of a box, it would be necessary to develop surfaces defining the box into directions intersecting with an axis of the connector terminal, a portion of the plate of which the box is formed has to be wider than the axis.

In such a condition, it would be necessary to align the connector terminals connected to a carrier at a wider pitch. Thus, in order to insert a plurality of the connector terminals into terminal storage rooms in a single step, a space between adjacent terminal storage rooms in a housing has to be increased as well as a space between adjacent connector terminals.

Accordingly, the box-shaped connector terminal prevents reduction in a contact pressure which the connector terminal exerts on a male connector terminal, but is accompanied with a problem that it is not possible to narrow a pitch between adjacent connector terminals.

In addition, there is a problem that in order to insert a plurality of connector terminals arranged at a small pitch into terminal storage rooms in a housing, connector terminals have to be separated from a carrier one by one, and inserted into each of the separated connector terminals into a terminal storage room.

SUMMARY OF THE INVENTION

In view of the above-mentioned problems in the conventional connector terminals, it is an object of the present invention to provide a connector terminal capable of being aligned at a small pitch, maintaining high reliability to electrical contact between itself and a male connector terminal.

A connector terminal includes first and second spring terminals between which a male connector terminal of a male electric connector is sandwiched. The connector terminal is formed by bending a strip-shaped plate about lines intersecting with a longitudinal line of the plate such that a width of the plate is maintained as it is, and the first and second spring terminals are formed with a limiter for preventing the first and second spring terminals from being outwardly deflected.

In the connector terminal in accordance with the present invention, since the limiter prevents the first and second spring terminals from being outwardly deflected, it is possible to prevent reduction in a contact pressure which the connector terminal exerts on a male connector terminal. Furthermore, since the connector terminal is formed by bending a strip-shaped plate about lines intersecting with a longitudinal line of the plate such that a width of the plate is maintained as it is, a maximum width of the strip-shaped plate can be designed to be reduced, unlike a box-shaped connector terminal having bending lines extending along an axis of the connector terminal. Thus, it is possible to align strip-shaped plates of each of which a connector terminal is formed, at a small pitch.

It is preferable that the lines are perpendicular to the longitudinal line.

It is preferable that the connector terminal further includes a connector through which the first and second spring terminals are connected. In that case, the limiter is comprised of a step extending over the first and second spring terminals and the connector for preventing the first and second spring terminals and the connector from being deformed.

By designing the limiter to be comprised of a step, the step is able to enhance rigidity of the first and second spring terminals, ensuring it is possible to prevent the first and second spring terminals from being excessively deformed due to the deflection of a male connector terminal.

It is preferable that the first spring terminal includes a first spring portion making contact with the male connector terminal, and a first spring support portion supporting the first spring portion. The second spring terminal includes a second spring portion making contact with the male connector terminal, and a second spring support portion supports the second spring portion. The connector connects a lower end of the first spring portion to a lower end of the second spring support portion, and the step extends from the first spring portion to the second spring support portion through the connector.

It is preferable that the first spring support portion includes a connector portion adapted to be fixed to a printed circuit board to which the male connector terminal is electrically connected.

Since the first and second spring terminals are supported by the connector portion, it is possible to cause the first and second spring terminals to follow the deflection of a male connector terminal after the male connector terminal is inserted into the connector terminal.

It is preferable that the first spring terminal includes a first spring portion making contact with the male connector terminal, and a first spring support portion supporting the first spring portion. The second spring terminal includes a second spring portion making contact with the male connector terminal, and a second spring support portion supports the second spring portion, the connector connecting a lower end of the first spring portion to a lower end of the second spring portion, and the step extends from the first spring portion to the second spring portion through the connector.

It is preferable that the first spring support portion includes a connector portion adapted to be fixed to a printed circuit board to which the male connector terminal is electrically connected, and the second spring support portion includes an engagement portion making engagement with a terminal storage room in which the connector terminal is housed.

Since the first and second spring terminals are supported between the connector portion and the engagement portion, it is possible to cause the first and second spring terminals to follow the deflection of a male connector terminal after the male connector terminal is inserted into the connector terminal.

It is preferable that the engagement portion and the second spring support portion are U-shaped.

It is preferable that the engagement portion includes an outwardly extending projection at an outer surface thereof.

The connector terminal in accordance with the present invention provides the following advantages.

The connector terminal in accordance with the present invention makes it possible to prevent reduction in a contact pressure which the connector terminal exerts on a male connector terminal, and to align strip-shaped plates of each of which the connector terminal is formed, at a small pitch, ensuring that the connector terminals can be aligned at a small pitch, providing high reliability to electrical contact between itself and a male connector terminal.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

A female electric connector in accordance with the first embodiment of the present invention is explained hereinbelow with reference to the drawings.

In the specification, a male connector terminal of the male electric connector is located "above" a printed circuit board.

In the specification, a male connector terminal of a male electric connector is inserted into a printed circuit board located "below" the male connector terminal.

Figure 1:
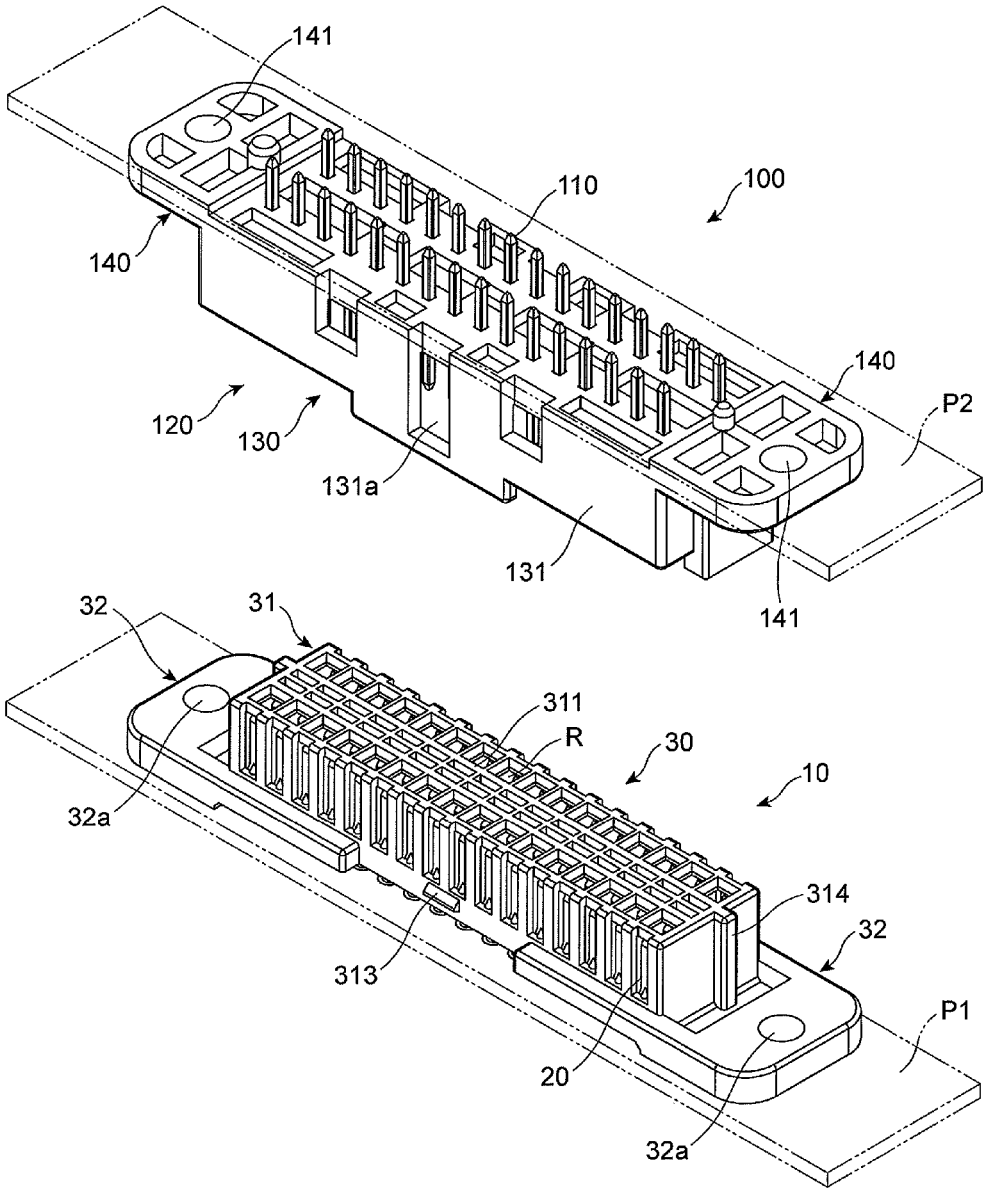
FIG. 1 is a perspective view of a female electric connector housing therein the connector terminals in accordance with the first embodiment of the present invention, and a male electric connector.

As illustrated in FIG. 1, the electric connector 10 is mounted on a printed circuit board P1, a circuit board to be equipped in an automobile, and is fit into a male electric connector 100 mounted on a printed circuit board P2, to thereby electrically connect the printed circuit boards P1 and P2 to each other.

The electric connector 10 includes a plurality of connector terminals 20, and a housing 30.

The connector terminal 20 illustrated in FIGS. 2A to 4B is inserted into a terminal storage room R formed in the housing 30 illustrated in FIG. 1. The connector terminal 20 includes a terminal main body 20*a* in which a male connector terminal 110 of the male electric connector 100 illustrated in FIG. 1 is inserted, and a connector portion 20*b* connecting and fixing the terminal main body 20*a* to the printed circuit board P1. The connector terminal 20 is inserted through a bottom thereof into a terminal storage room R.

The terminal main body 20*a* includes a first spring terminal 21, a second spring terminal 22, and a joint portion (connector part) 23 connecting the first and second spring terminals 21 and 22 to each other.

The first spring terminal 21 includes a first spring portion 211 making contact with one side of the male connector terminal 110, and a first spring support portion 212 supporting the first spring portion 211.

The second spring terminal 22 includes a second spring portion 221 making contact with the other side of the male connector terminal 110, and a second spring support portion 222 supporting the second spring portion 221.

The first spring portion 211 has a structure of a flat spring, and suspends from a resilient portion 212*a* located at a distal end of the first spring support portion 212.

The first spring support portion 212 has an increased-width portion 212*b* in the vicinity of a proximal end closer to the printed circuit board P1. A width of the first spring support portion 212 gradually decreases towards a distal end from the width-increased portion 212*b*, and the first spring support portion 212 is connected at a distal end thereof to the resilient portion 212*a*. The increased-width portion 212*b* is formed at sides thereof with sawtooth-shaped projections (not illustrated) which make engagement with sidewalls of the terminal storage room R of the housing 30. The resilient portion 212*a* is designed to have a width smaller than the width of the increased-width portion 212*b* so as to be able to readily resiliently deform.

The first spring support portion 212 is formed at an outer surface (opposite side relative to the first spring portion 211) with a substantially triangular projection 212*c* making engagement with a later-mentioned raised portion of the housing 30. The projection 212*c* is formed by pressing, including a step of cutting a bottom of the triangle.

The second spring portion 221 is disposed facing the first spring portion 211 such that there is formed an insertion space S between the first spring portion 211 and the second spring portion 221, into which the male connector terminal 110 of the male electric connector 100 is inserted. The second spring portion 221 downwardly extends from a bending portion 222*a* located at a top end of the second spring support portion 222 to thereby make contact with the other side of the male connector terminal 110. The second spring portion 221 is formed at a distal end thereof with a contact 221*a* formed by bending the metal plate substantially V-shaped.

The second spring support portion 222 is formed at an outer surface thereof (a rear surface located opposite to the second spring portion 221) with a substantially triangular projection 222*b* making engagement with a later-mentioned lance portion 311*a* (see FIG. 9) of the housing 30. The projection 222*b* can be formed by pressing, including a step of cutting a bottom of the triangle.

The joint portion (connector part) 23 is designed to have a width almost equal to the same of the first spring portion 211 and the second spring support portion 222, and connect a bottom of the first spring portion 211 to a bottom of the second spring support portion 222.

A step 25 is formed over the first spring portion 211, the joint portion 23, and the second spring support portion 222. The step 25 acts as a limiter for preventing a space between the first spring portion 211 and the second spring support portion 222 from expanding to thereby prevent the first spring portion 211, the joint portion 23, and the second spring support portion 222 from being deformed.

Figure 2A:
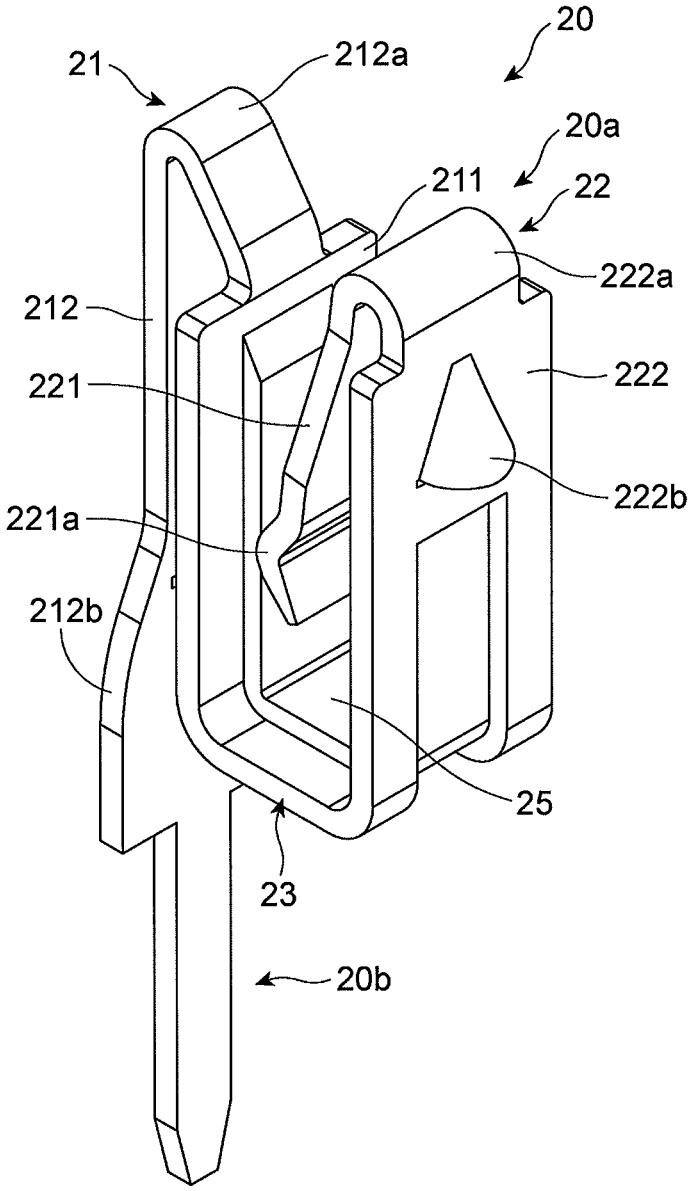
FIG. 2A is a perspective view of the connector terminal in accordance with the first embodiment of the present invention, viewed in a direction of the second spring support portion.
Figure 2B:
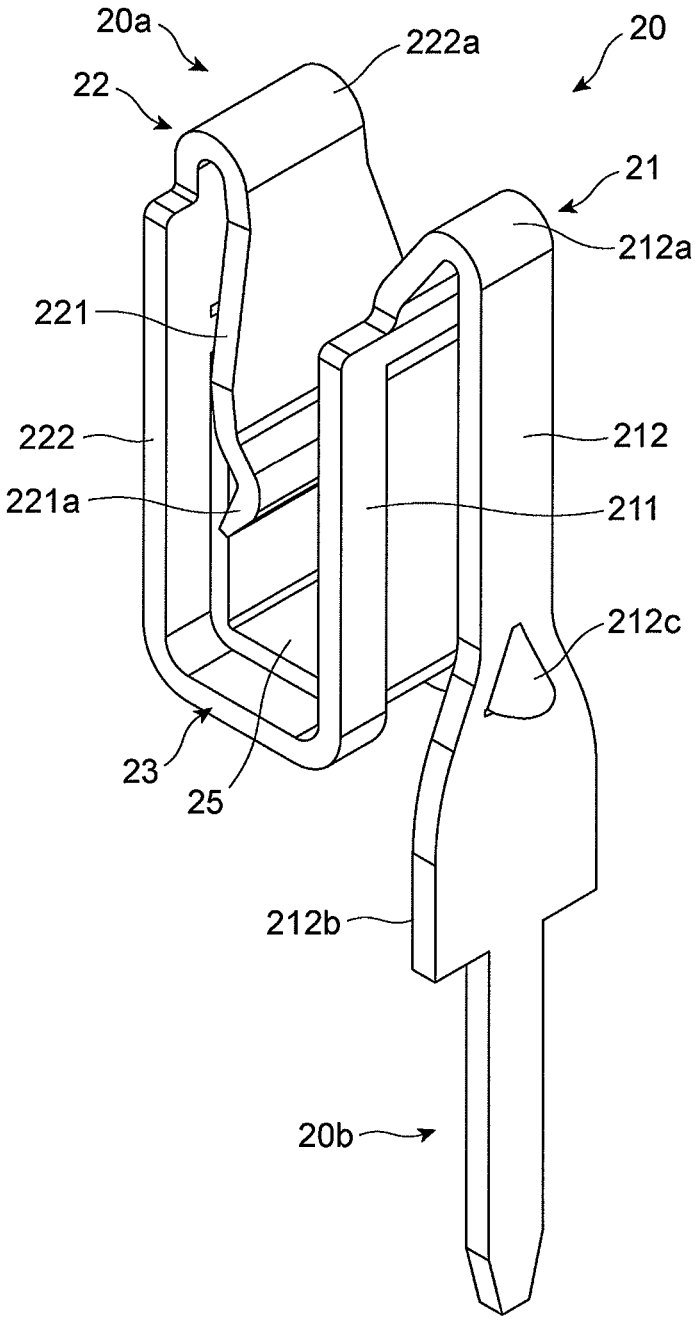
FIG. 2B is a perspective view of the connector terminal in accordance with the first embodiment of the present invention, viewed in a direction of the first spring support portion.
Figure 3A:
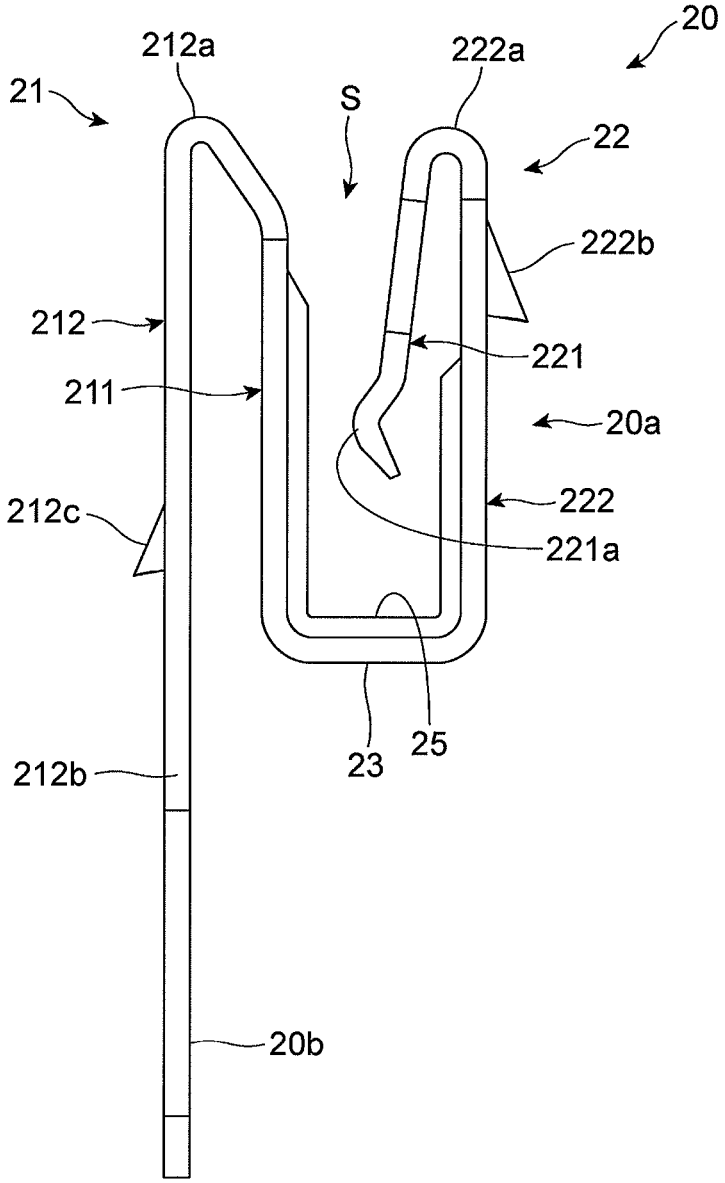
FIG. 3A is a front view of the connector terminal illustrated in FIGS. 2A and 2B.
Figure 3B:
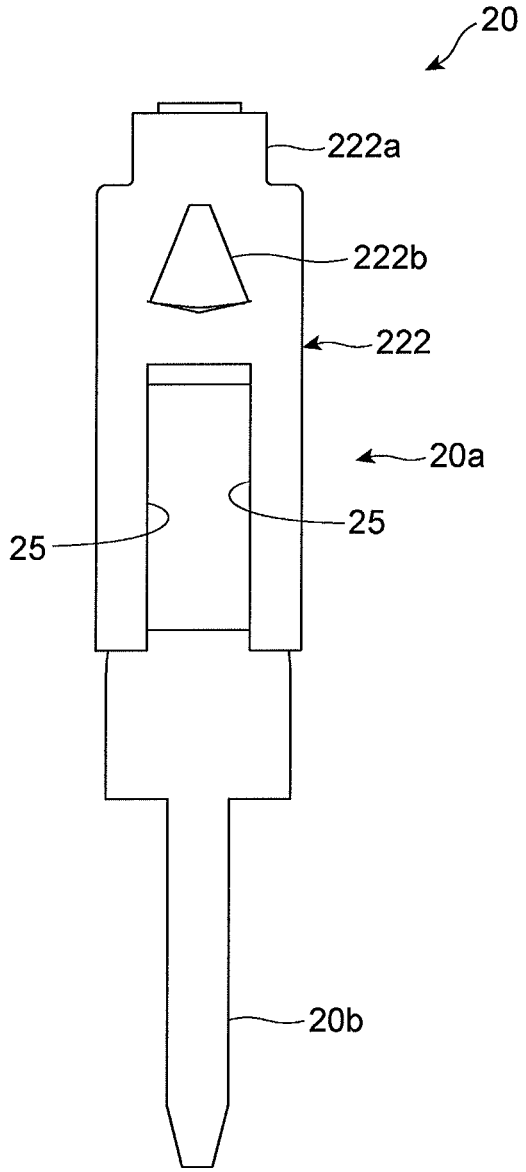
FIG. 3B is a right side view of the connector terminal illustrated in FIGS. 2A and 2B.
Figure 4A:
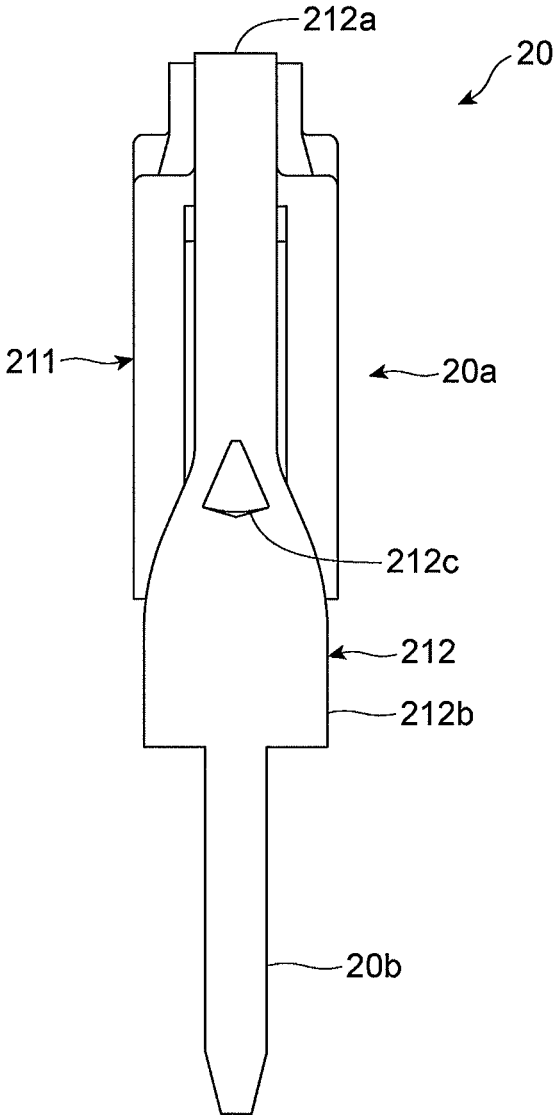
FIG. 4A is a left side view of the connector terminal illustrated in FIGS. 2A and 2B.
Figure 4B:
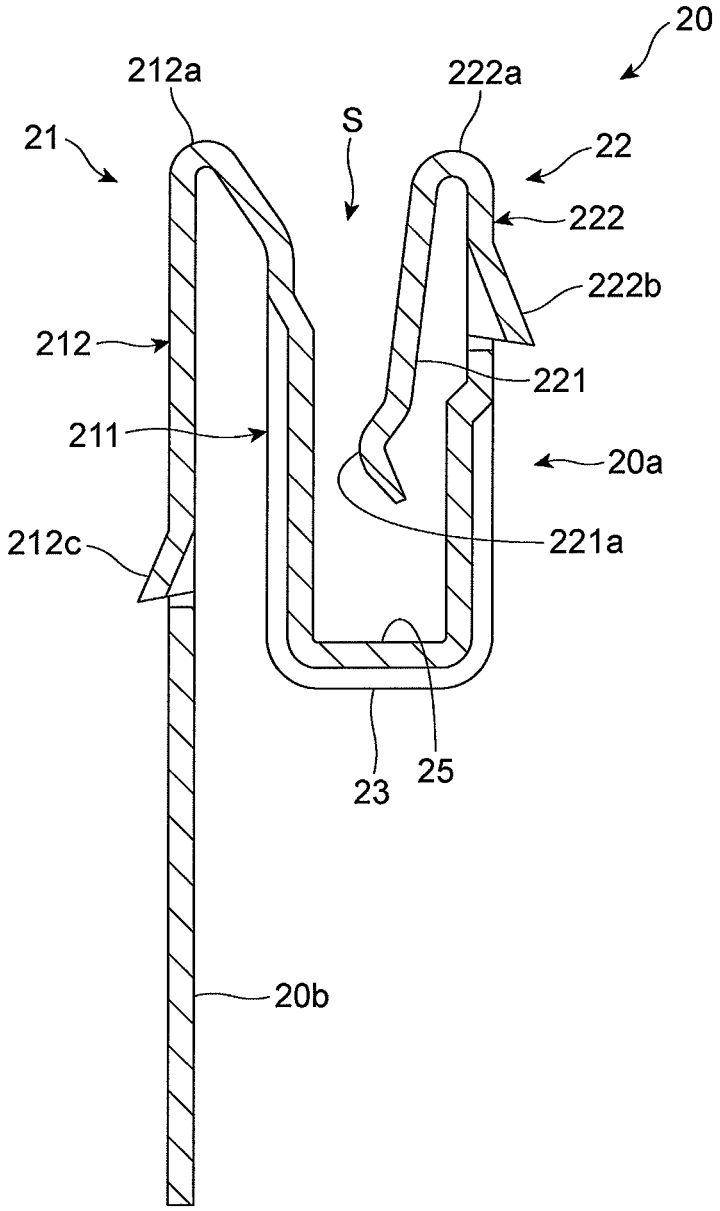
FIG. 4B is a cross-sectional view of the connector terminal illustrated in FIGS. 2A and 2B.
Figure 6A:
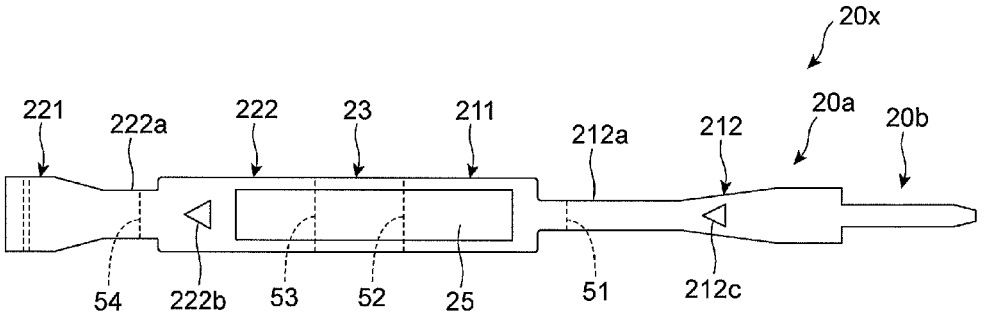
FIG. 6A is a plan view showing bending points of the connector terminal in a developed state.
Figure 6B:
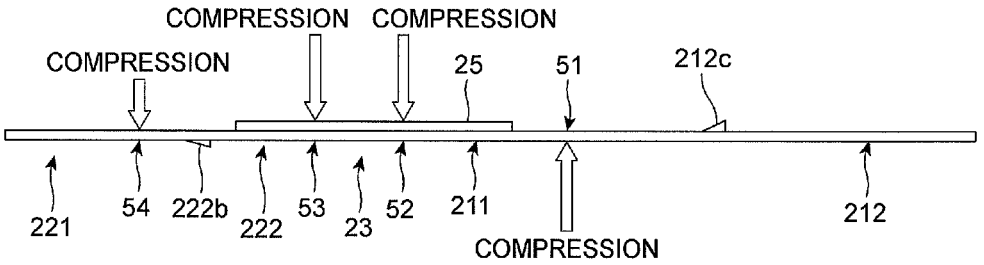
FIG. 6B is a front view showing bending points and directions of the connector terminal shown in FIG. 6A.

As best illustrated in FIGS. 3A, 4B, and 6B, the step (limiter) 25 is integrally formed on the first spring portion 211, the connector part 23, and the second spring support portion 222. The step (limiter) 25 is formed by beading such that the step 25 has a raised surface at one side and a recessed surface at the other side. By forming the step 25 by beading, two steps each including a raised surface and a recessed surface can be formed in a single step over the first spring portion 211, the joint portion 23, and the second spring support portion 222. Though the step 25 of the connector terminal 20 illustrated in FIGS. 2A and 2B is designed to have a trapezoidal cross-section, the step 25 may be designed to have a semi-circular cross-section.

The connector portion 20*b* is in the form of a needle such that it can be readily and fixedly inserted into the printed circuit board P1. The connector portion 20*b* is connected to a proximal end of the first spring support portion 212 of the terminal main body 20*a*.

A process of fabricating the connector terminal 20 is explained hereinbelow with reference to FIGS. 5 and 6.

Figure 5:
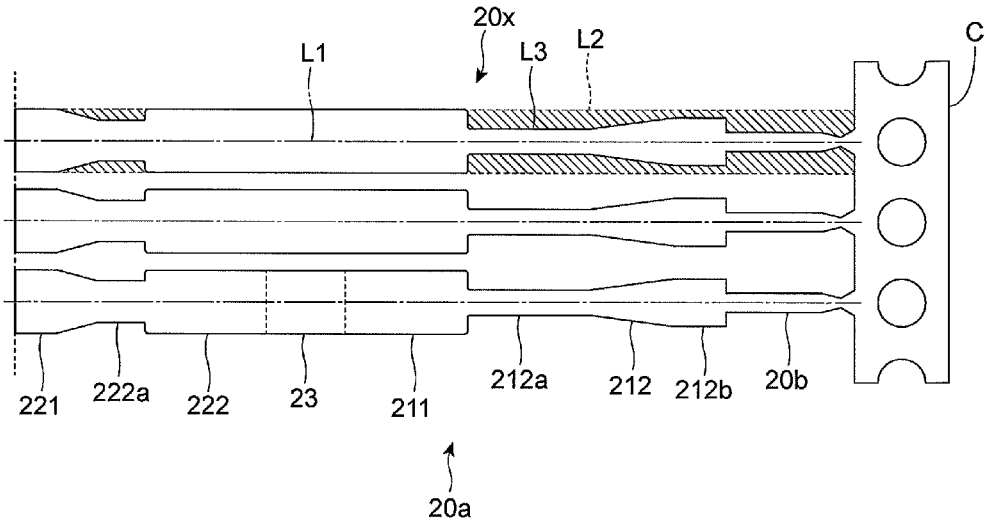
FIG. 5 is a plan view illustrating a carrier and a plurality of the developed connector terminals connected to the carrier.

As illustrated in FIG. 5, a metal plate is punched such that a plurality of connector terminals 20X in a developed condition are aligned in a line along a length-wise direction of a carrier C. A space between adjacent axes L1 of the developed connector terminals 20X is set equal to a space between the adjacent terminal storage rooms R in the housing 30.

Then, a beading process is applied to the developed connector terminals 20X in the form of a strip-shaped plate to thereby form the step 25 (see FIGS. 2A and 2B). Then, the developed connector terminals 20X are pressed to thereby form the projections 212*c* and 222*b*. Then, each of the developed connector terminals 20X is bent about bending lines perpendicularly intersecting with the axes L1.

Specifically, as illustrated in FIGS. 6A and 6B, the first spring support portion 212 is compressed at a lower surface at a first bending point 51 to thereby be bent in the form of a hairpin. The resilient portion 212*a* is formed at the first bending point 51. Then, the developed connector terminal 20X is compressed at an upper surface at a second bending point 52 located between the first spring portion 211 and the joint portion 23 to thereby almost perpendicularly bent, and is further compressed at an upper surface at a third bending point 53 located between the joint portion 23 and the second spring support portion 222 to thereby almost perpendicularly bent. Furthermore, the developed connector terminal 20X is compressed at an upper surface at a fourth bending point 54 located between the second spring support portion 222 and the second spring portion 221 to thereby be bent in the form of a hairpin. The resilient portion 222*a* is formed at the fourth bending point 54. Each of the developed connector terminals 20X is bent at the first to fourth bending points 51 to 54 such that a length of each of the developed connector terminals 20X is shortened, resulting in forming a plurality of the connector terminals 20X connected to the carrier C, as illustrated in FIG. 7.

Figure 7:
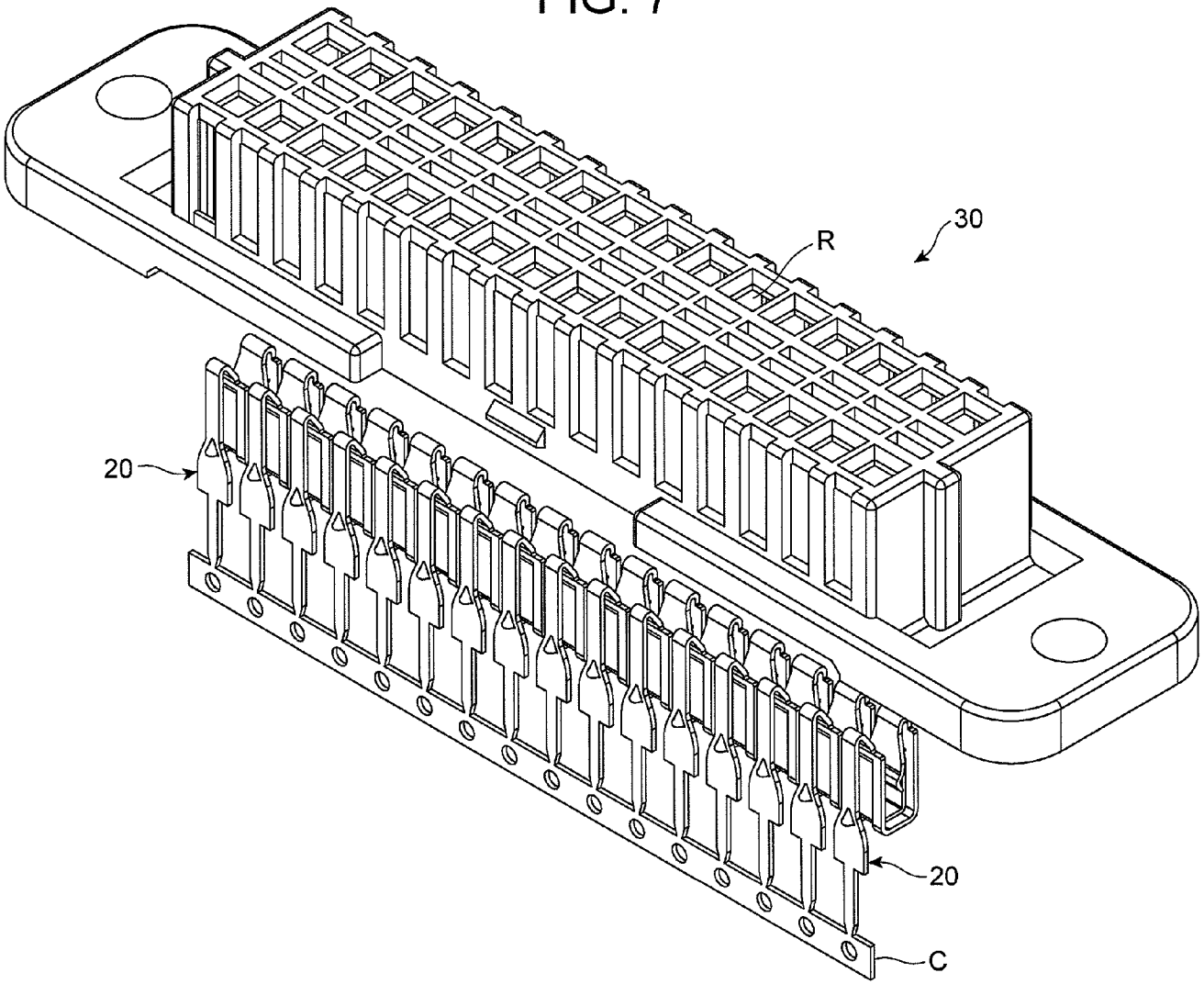
FIG. 7 is a perspective view of the connector terminals to be inserted into a housing.
Figure 8:
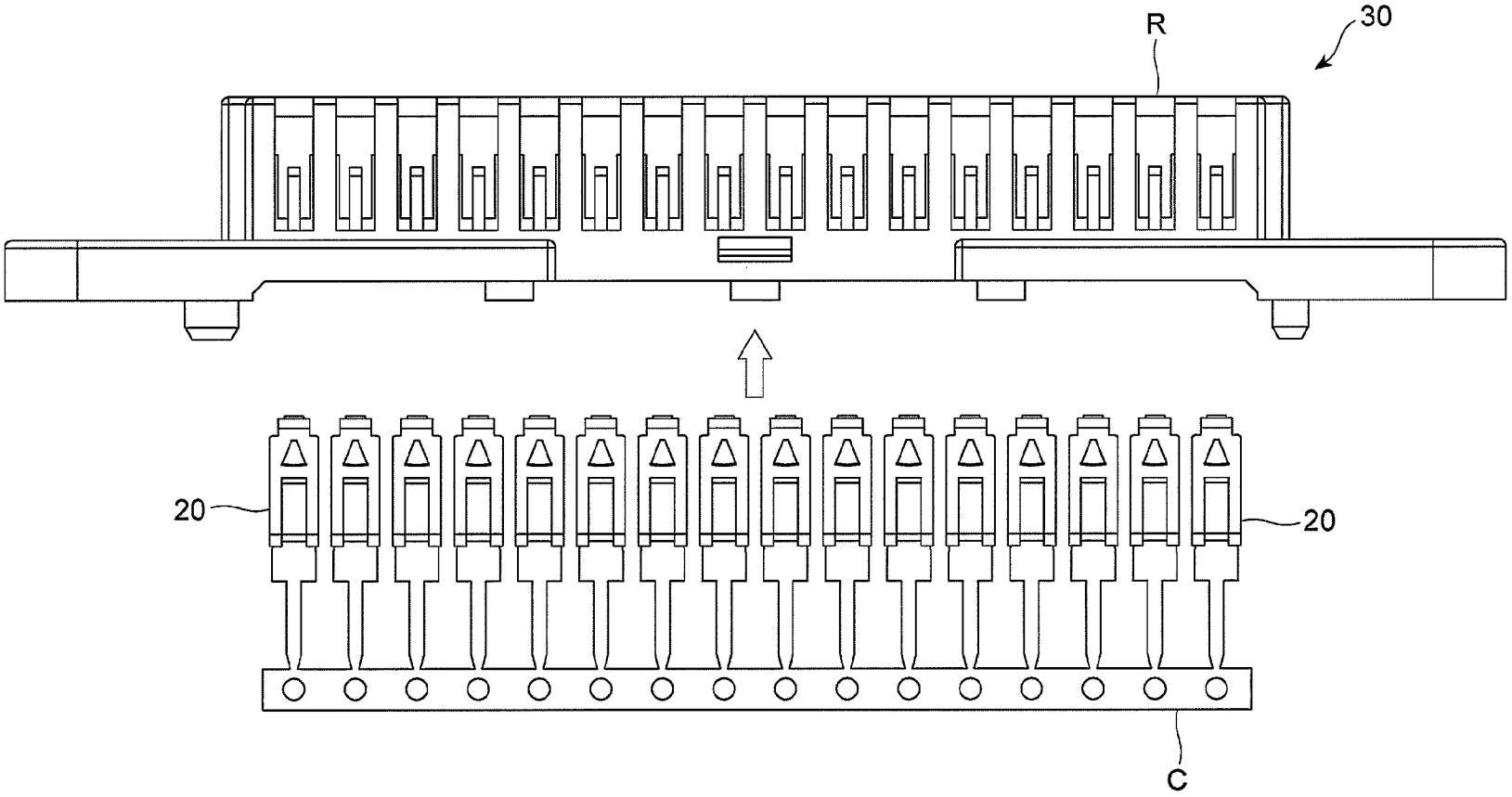
FIG. 8 is a front view of the connector terminals and the housing both illustrated in FIG. 7.

Then, as illustrated in FIGS. 7 and 8, a plurality of the connector terminals 20 connected to the carrier C is inserted as it is into the terminal storage rooms R of the housing 30 through bottoms of the terminal storage rooms R. Thus, a line of the connector terminals 20 can be inserted into the terminal storage rooms R in a single step.

In the fabrication of the developed connector terminals 20X by punching a metal plate, both areas sandwiched between the adjacent developed connector terminals 20X and hatched areas illustrated in FIG. 5 (hereinafter, hatched areas are called "waste areas") in a metal plate are waste.

Specifically, each of the waste areas is defined as an area surrounded by imaginary lines L2 which are in parallel with the axis L1 of the developed connector terminal 20X and define a maximum width of the developed connector terminal 20X, and a border line L3 of the developed connector terminal 20X.

The adjacent developed connector terminals 20X have to be spaced away from each other by a certain length, but it is possible to reduce a volume of waste metal, if the adjacent developed connector terminals 20X can minimize the space from each other. However, the broader the waste area is, the broader an area sandwiched between the imaginary lines L2 and the border line L3 is.

For instance, since the terminal main body is box-shaped in the above-mentioned conventional connector terminals, it is necessary to develop surfaces defining the box-shaped terminal main body, in directions intersecting with an axis of the connector terminal, resulting in that a portion of a plate defining the box-shaped terminal main body has to be wide. Hence, the waste area becomes broad in accordance with a width of a developed box-shaped terminal main body, resulting in that a volume of waste metal significantly increases.

Since the connector terminal 20X is formed by bending the developed connector terminal 20X not about the axis L1, but about bending lines intersecting with the axis L1 in order to make a width of the developed connector terminal 20X be equal to a width of the resultant connector terminal 20. Thus, it is possible to design the developed connector terminal 20X to have a reduced maximum width unlike a box-shaped developed connector terminal in which portions are bent about bending lines extending in parallel with the axis L1. Accordingly, a volume of waste metal can be reduced.

Furthermore, since a maximum width of the developed connector terminal 20X in the connector terminal 20 can be designed smaller than the same in the above-mentioned conventional connector terminals, it is possible to align the developed connector terminals 20X along the carrier C as close as possible. Hence, a space between the adjacent terminal storage rooms R in the housing 30 can be made smaller, ensuring that the connector terminals 20 can be arranged at a smaller pitch in the electric connector 10.

The housing 30 is explained hereinbelow with reference to FIGS. 1 to 9.

The housing 30 is substantially rectangular, when viewed vertically, and includes a housing main body 31 in which the terminal storage rooms R into each of which the connector terminal 20 is housed are formed in a matrix, and a pair of flanges 32 outwardly extending from opposite ends of the housing main body 31 in a length-wise direction of the housing main body 31.

Figure 9:
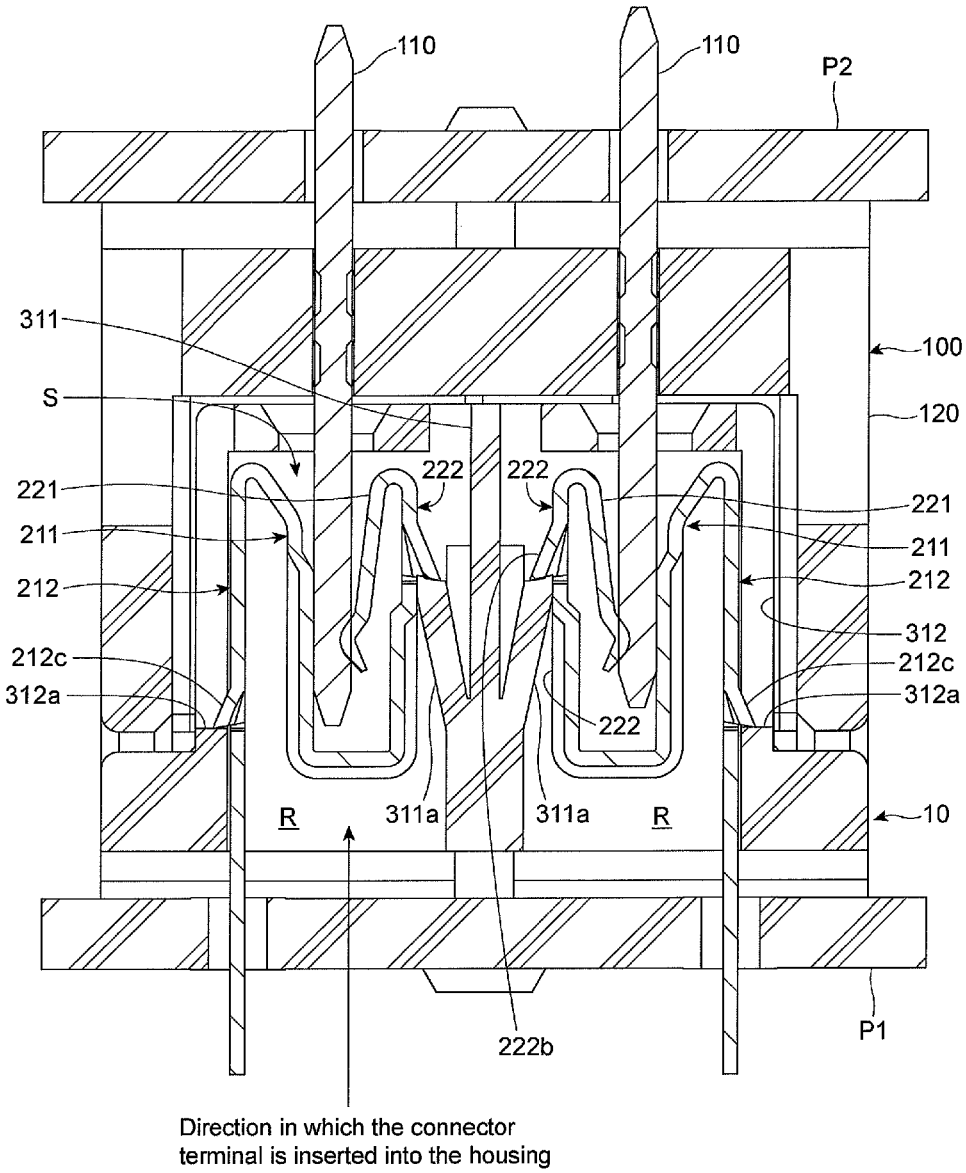
FIG. 9 is a cross-sectional view of a female electric connector into which a male electric connector is inserted.

As illustrated in FIG. 9, the housing main body 31 is formed with a partition wall 311 separating two rows of the terminal storage rooms R from each other, aligned in a length-wise direction of the housing main body 31. A pair of lance portions 311*a* extends from opposite surfaces of the partition wall 311. Each of the lance portions 311*a* acts as a support with which the projection 222*b* of the second spring support portion 222 makes engagement. Since the connector terminal 20 is inserted into the terminal storage room R through a bottom of the terminal storage room R, and the second spring support portion 222 inclines in such a direction that an upper portion of the second spring support portion 222 outwardly inclines about a bottom thereof, the lance portions 311*a* extend obliquely upwardly towards an upper portion of the second spring support portion 222 from a bottom of the partition wall 311.

The housing main body 31 is formed with pedestals 312*a* extending from inner walls 312 facing the partition wall 311. Each of the pedestals 312*a* acts as a projection with which the projection 212*c* of the first spring support portion 212 makes engagement. Furthermore, as illustrated in FIG. 1, the housing main body 31 is formed with engagement projections 313 and engagement projections 314 with both of which a housing of the male electric connector 100 makes engagement, when the housing main body 31 and the housing of the male electric connector 100 are fit to each other.

Each of the flanges 32 is formed with a through-hole 32*a* through which the printed circuit board P1 is fixed by means of a fixing unit.

The connector terminal 20 inserted into the housing 30 is explained hereinbelow with reference to FIG. 9.

When the connector terminal 20 is inserted into the terminal storage room R, the lance portion 311*a* is pushed to a rear surface of the second spring support portion 222. Hence, the lance portion 311*a* is deformed in such a direction that the lance portion 311*a* is open relative to a direction in which the connector terminal 20 is inserted into the housing 30. When the projection 222*b* mounts on the lance portion 311*a*, the lance portion 311*a* is further resiliently deformed. When the projection 222*b* goes beyond the lance portion 311*a*, the lance portion 311*a* returns to its original shape. Hence, the lance portion 311*a* abuts a rear surface of the second spring support portion 222 by virtue of a resilient reaction force of the lance portion 311*a*.

The male electric connector 100 mounted on the printed circuit board P2 is explained hereinbelow with reference to the drawings.

As illustrated in FIG. 1, the electric connector 100 includes a plurality of needle-shaped male connector terminals 110 having one end to be inserted into and fixed in the printed circuit board P2 and the other end to be inserted into the connector terminal 20 (see FIG. 1) of the electric connector 10, and a housing 120 into which the housing 30 of the electric connector 10 is inserted and fit.

The housing 120 includes a housing main body 130 in the form of a box, which has a bottom and is open for fitting with the housing 30 of the electric connector 10. Further, the male connector terminals 110 are fixed in a matrix, and flanges 140 extending from opposite ends of the housing main body 130 in a length-wise direction of the housing main body 130.

The housing main body 130 has a peripheral wall 131 with engagement openings 131*a* and engagement recesses into which the engagement projections 313 and 314 of the housing 30 of the male electric connector 10 are fit, respectively. Since the engagement between the engagement projections 313 and the engagement openings 131*a* and between the engagement projections 314 and the engagement recess is designed to be a fitting with play (so-called free fit), the electric connectors 10 and 100 are able to slightly move relative to each other. Each of the flanges 140 is formed with a through-hole 141 through which the flange 140 is fixed onto the printed circuit board P2 by means of a fixing unit.

The electric connector 10 in accordance with the first embodiment of the present invention, having the above-mentioned structure, is used as follows.

As illustrated in FIG. 1, the male electric connector 100 mounted on the printed circuit board P2 is disposed above the female electric connector 100 mounted on the printed circuit board P2, and then, as illustrated in FIG. 9, the electric connectors 10 and 100 are coupled to each other. Each of the male connector terminals 110 arranged in the housing 120 of the electric connector 100 is inserted into the insertion space S of the connector terminal 20.

Being inserted into the connector terminal 20, the male connector terminal 110 makes contact at one side thereof with the first spring portion 211 and at the other side thereof with the second spring portion 221. The male connector terminal 110 deeply enters the connector terminal 20, making sliding contact with the connector terminal 20.

Herein, it is supposed that the male connector terminal 110 is inserted into the connector terminal 20 with a positional relation between the printed circuit boards P1 and P2 being deflected, or that after the male connector terminal 110 has been inserted into the connector terminal 20, a positional relation between the printed circuit boards P1 and P2 is deflected due to oscillation. Hence, the male connector terminal 110 now being inserted into the connector terminal 20 oscillates.

Figure 10:
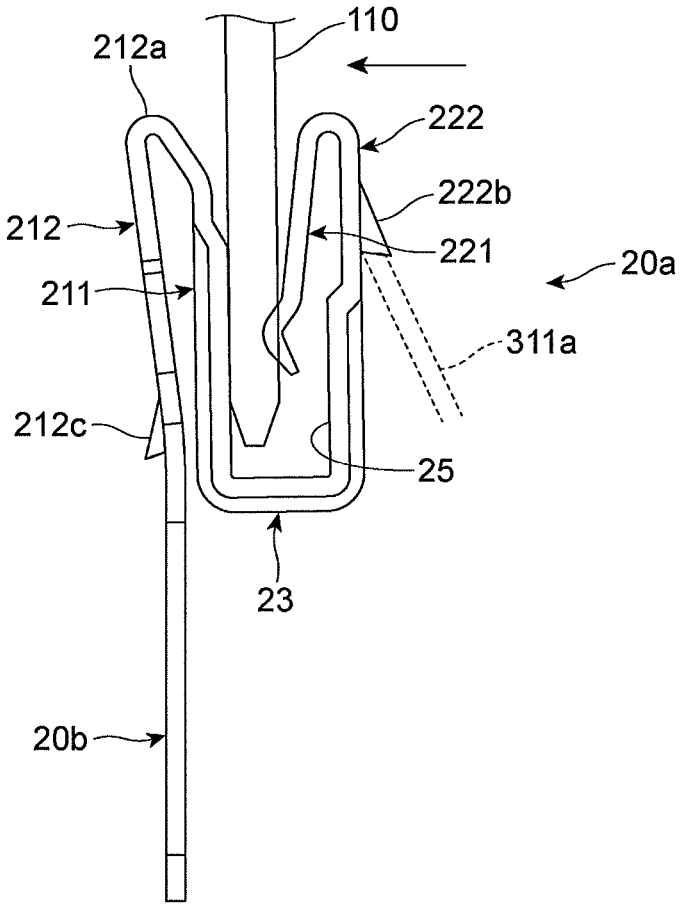
FIG. 10 is a front view of a male connector terminal inserted into the connector terminal illustrated in FIGS. 2A and 2B, moving horizontally towards the first spring portion.

For instance, if the male connector terminal 110 deflects towards the first spring portion 211 as illustrated in FIG. 10, the first spring portion 211 is compressed due to the deflection of the male connector terminal 110. Thus, a space between the first spring portion 211 and the second spring portion 221 is caused to expand. However, since the first spring portion 211 and the second spring support portion 222 are connected at bottoms thereof to each other through the joint portion 23, and further since the step 25 is formed over the first spring portion 211, the joint portion 23, and the second spring support portion 222, it is possible to enhance rigidity of the first spring portion 211, the joint portion 23, and the second spring support portion 222 which are U-shaped.

Accordingly, since the first spring portion 211 and the second spring support portion 222 are difficult to excessively deform in such a direction that the first spring portion 211 and the second spring support portion 222 are away from each other, the second spring support portion 222 is drawn towards the first spring portion 211 moving outwardly, ensuring that the second spring portion 221 is drawn towards the first spring portion 211 with the second spring portion 221 being kept in contact with the male connector terminal 110.

Consequently, it is possible to move both the first spring portion 211 and the second spring portion 221 to a position to which the male connector terminal 110 has moved, since the resilient portion 212*a* disposed at a distal end of the first spring support portion 212 fixed to the connector portion 20*b* is resiliently closed, keeping the terminal main body 20*a* in contact with the male connector terminal 110. Thus, since a space between the first spring portion 211 and the second spring portion 221 is kept constant, it is possible to maintain a contact pressure which the second spring portion 221 exerts on the male connector terminal 110 by virtue of a resilient reaction force thereof.

In this situation, as illustrated in FIG. 9, since the lance portion 311*a* obliquely extending from the partition wall 311 makes abutment with a rear surface of the second spring support portion 222 by virtue of a resilient reaction force of the lance portion 311*a*, the direction in which the lance portion 311*a* is inclined changes due to the resilient deformation of the lance portion 311*a* to a direction in which the lance portion 311*a* is closed relative to an inner wall of the terminal storage room R. Hence, the lance portion 311*a* at a distal end thereof follows the movement of the terminal main body 20*a*. Thus, it is possible to prevent the lance portion 311*a* at a distal end thereof from being disengaged from the projection 222*b*.

Figure 11:
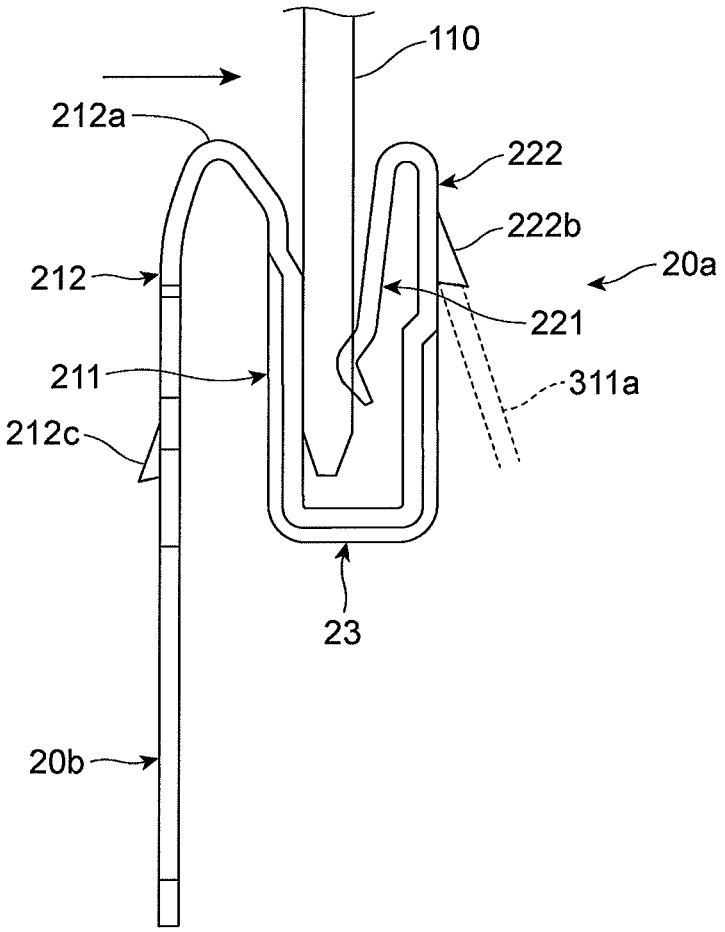
FIG. 11 is a front view of a male connector terminal inserted into the connector terminal illustrated in FIGS. 2A and 2B, moving horizontally towards the second spring portion.

As illustrated in FIG. 11, if the male connector terminal 110 deflects towards the second spring portion 221, the second spring portion 221 is compressed due to the deflection of the male connector terminal 110, and the direction in which the lance portion 311*a* is inclined changes due to the resilient deformation of the lance portion 311*a* to a direction in which the lance portion 311*a* is open relative to an inner wall of the terminal storage room R. Thus, the second spring portion 221 attempts to move away from the first spring portion 211.

However, since the first spring portion 211 and the second spring support portion 222 are connected at bottoms thereof to each other through the joint portion 23, the first spring portion 211 is drawn towards the second spring support portion 222. Consequently, it is possible to move both the first spring portion 211 and the second spring portion 221 to a position to which the male connector terminal 110 has moved, since the resilient portion 212*a* is resiliently open, keeping the terminal main body 20*a* in contact with the male connector terminal 110. Thus, since a space between the first spring portion 211 and the second spring support portion 221 is kept constant, it is possible to maintain a contact pressure which the second spring portion 221 exerts on the male connector terminal 110 by virtue of a resilient reaction force thereof.

Furthermore, as mentioned above, since the lance portion 311*a* obliquely extending from the partition wall 311 makes engagement with the projection 222*b* of the second spring support portion 222, the lance portion 311*a* upwardly supports the second spring support portion 222 to thereby prevent the second spring support portion 222 from inclining.

Accordingly, since the lance portion 311*a* prevents the second spring support portion 222 from outwardly inclining about a bottom of the second spring support portion 222, it is possible to prevent the second spring portion 221 from being open because the second spring support portion 222 is prevented from upwardly inclining to thereby excessively deform. Hence, a contact pressure between the first spring portion 211 and the second spring portion 221 can be maintained. Thus, it is possible to prevent reduction in reliability to electrical connection between the terminal main body 20*a* and the male connector terminal 110.

As mentioned above, even if a positional relation between the printed circuit boards P1 and P2 were deflected due to oscillation so that the male connector terminal 110 were deflected, the terminal main body 20*a* could swing and follow the deflection, maintaining a contact pressure which the first spring portion 211 and the second spring portion 221 exert on the male connector terminal 110. Thus, it is possible to avoid reduction in reliability of electrical connection between the male connector terminal 110 and the connector terminal 20.

In the connector terminal 20 in accordance with the first embodiment of the present invention, since the step 25 acting as a limiter is formed from an upper portion of a straight portion of the first spring portion 211 of the first spring terminal 21 to a position immediately below the projection 222*b* of the second spring support portion 222 of the second spring terminal 22 through the joint portion 23 for the purpose of enhancing rigidity of the terminal main body 20*a*, it is possible to prevent the first and second spring terminals 21 and 22 from outwardly inclining, ensuring that it is possible to avoid reduction in a contact pressure which the connector terminal 20 exerts on the male connector terminal 110.

Furthermore, since the connector terminal 20 is formed by bending the developed connector terminal 20X about bending lines intersecting with the axis L1 of the developed connector terminal 20X, it is possible to reduce a volume of waste metal, and further, to arrange the connector terminals 20 at a smaller pitch. Thus, the connector terminal 20 in accordance with the first embodiment makes it possible to prevent reduction in a contact pressure between itself and the male connector terminal 110, to be arranged at a smaller pitch, and to simplify a process of assembling the connector terminal 20.

Second Embodiment

A connector terminal to be used in a male electric connector, in accordance with the second embodiment of the present invention, is explained hereinbelow with reference to the drawings.

Figure 12A:
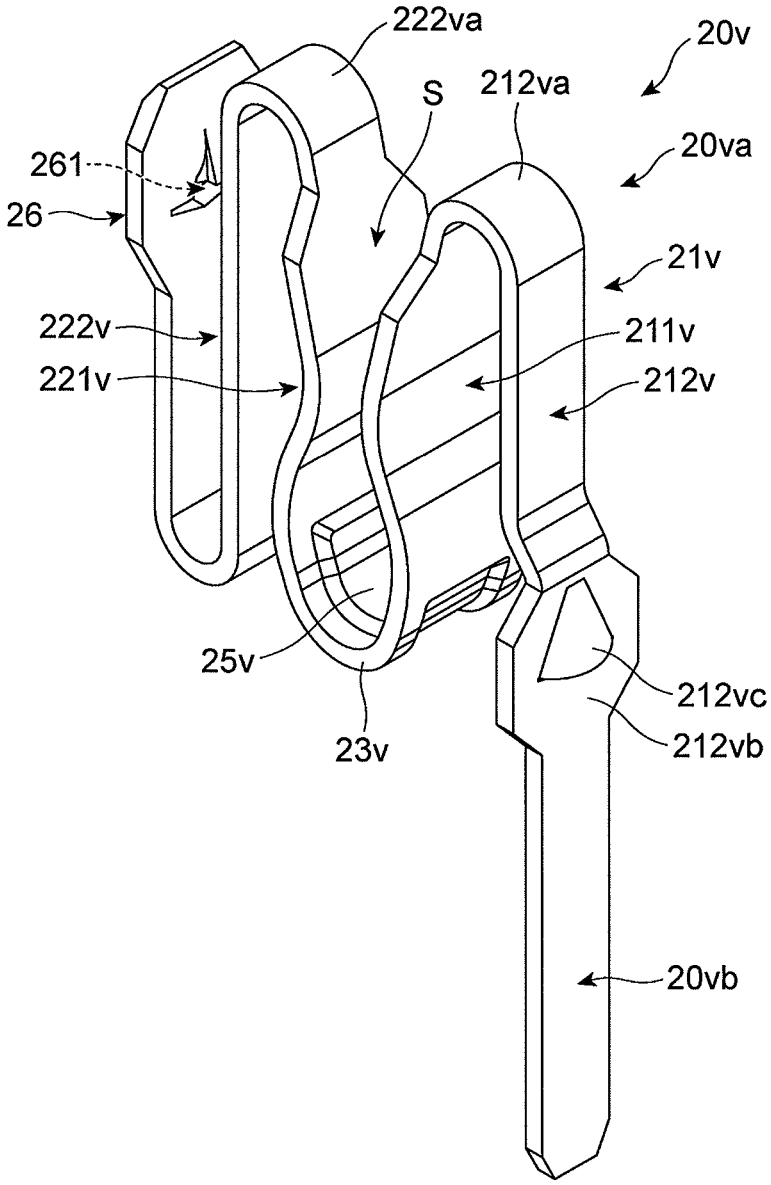
FIG. 12A is a perspective view of the connector terminal in accordance with the second embodiment of the present invention, viewed in a direction of the first spring support portion.
Figure 12B:
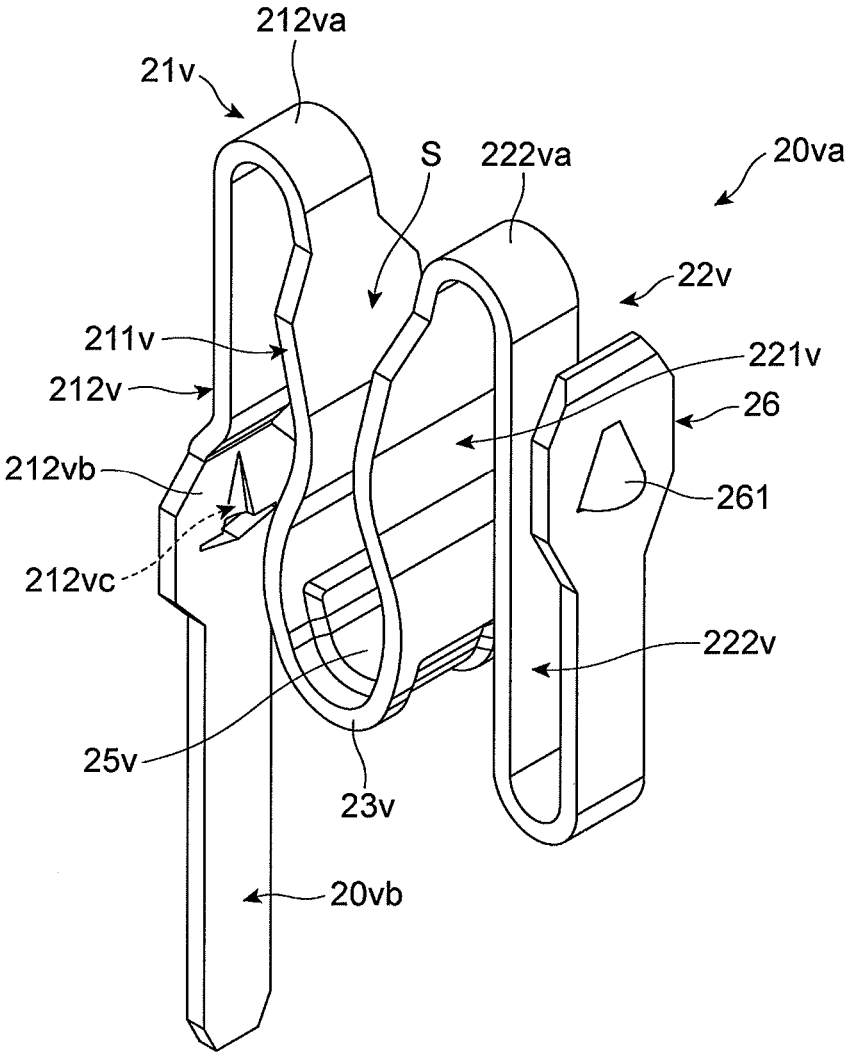
FIG. 12B is a perspective view of the connector terminal in accordance with the second embodiment of the present invention, viewed in a direction of the engagement portion.
Figure 13A:
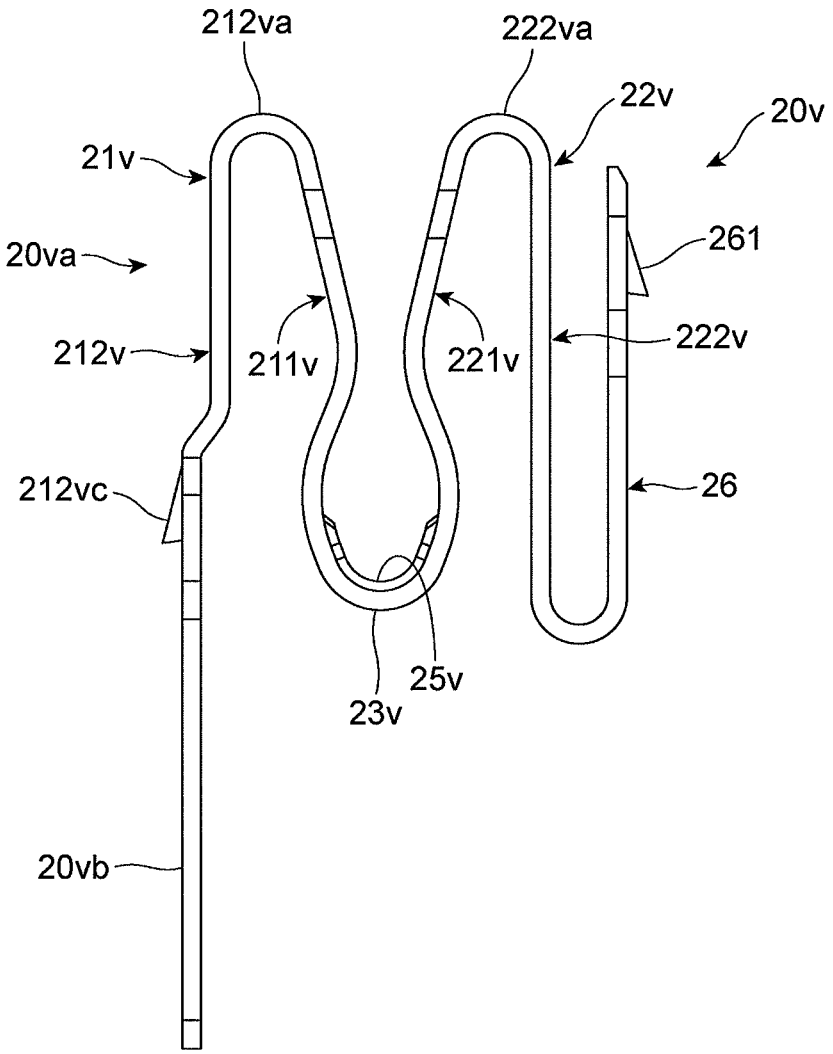
FIG. 13A is a front view of the connector terminal illustrated in FIGS. 12A and 12B.
Figure 13B:
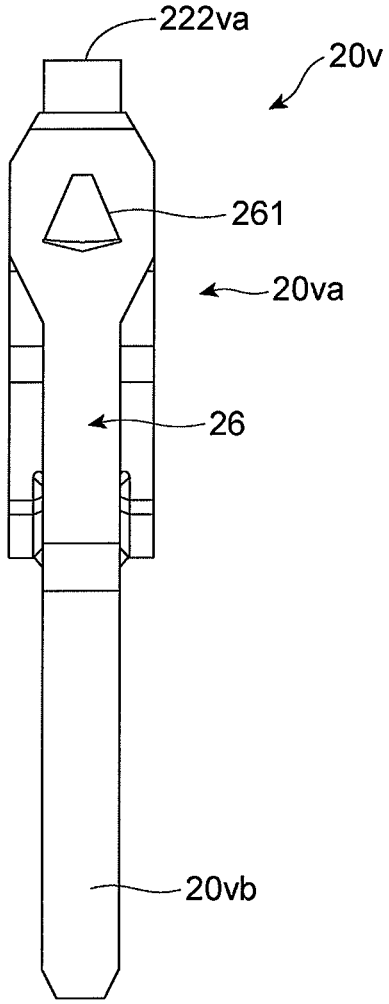
FIG. 13B is a right side view of the connector terminal illustrated in FIGS. 12A and 12B.
Figure 14A:
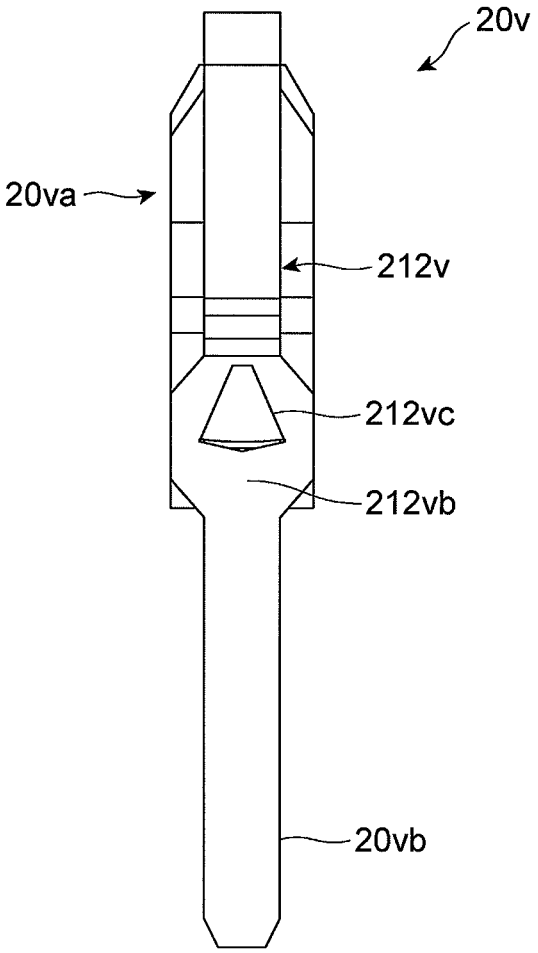
FIG. 14A is a left side view of the connector terminal illustrated in FIGS. 12A and 12B.
Figure 14B:
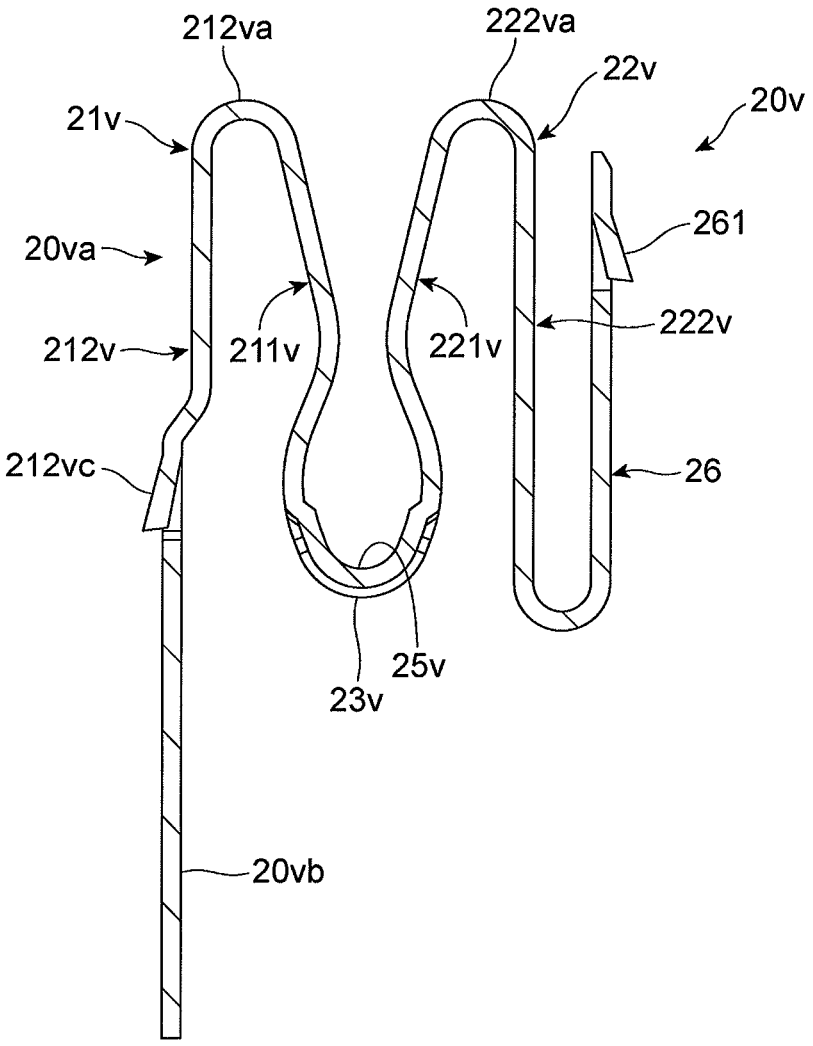
FIG. 14B is a cross-sectional view of the connector terminal illustrated in FIGS. 12A and 12B.

A connector terminal 20V illustrated in FIGS. 12 to 14 includes a terminal main body 20*va* in which the male connector terminal 110 of the male electric connector 100 illustrated in FIG. 1 is inserted, a connector portion 20*vb* connecting and fixing the terminal main body 20*va* to the printed circuit board P1, and an engagement portion 26 located opposite to the connector portion 20*vb* about the terminal main body 20*va*. The connector terminal 20V is inserted through a bottom thereof into the terminal storage room R of the housing 30 illustrated in FIG. 1.

The terminal main body 20*va* includes a first spring terminal 21*v*, a second spring terminal 22*v*, and a joint portion 23*v* connecting the first and second spring terminals 21*v* and 22*v* to each other.

The first spring terminal 21*v* includes a first spring portion 211*v* making contact with one side of the male connector terminal 110, and a first spring support portion 212*v* supporting the first spring portion 211*v*.

The second spring terminal 22*v* includes a second spring portion 221*v* making contact with the other side of the male connector terminal 110, and a second spring support portion 222*v* supporting the second spring portion 221*v*.

The first spring portion 211*v* has a structure of a flat spring, and suspends from a resilient portion 212*va* located at a distal end of the first spring support portion 212*v*. The first spring portion 211*v* is in the form of an arch to thereby have a raised surface with which the male connector terminal 110 makes contact.

The first spring support portion 212*v* has a width-increased portion 212*vb* in the vicinity of a proximal end closer to the printed circuit board P1. The first spring support portion 212 is connected at a distal end thereof to the resilient portion 212*va*. The width-increased portion 212*vb* is formed at sides thereof with sawtooth-shaped projections (not illustrated) which make engagement with sidewalls of the terminal storage room R of the housing 30. The resilient portion 212*va* is designed to have a width smaller than the same of the width-increased portion 212*vb* so as to be able to readily resiliently deform.

The first spring support portion 212*v* is formed at an outer surface (opposite side relative to the first spring portion 211*v*) with a substantially triangular projection 212*vc* making engagement with a projection of the housing 30. The projection 212*vc* is formed by pressing, including a step of cutting a bottom of the triangle.

The second spring portion 221*v* is in the form of an arch to thereby have a raised surface with which the male connector terminal 110 makes contact. The second spring portion 221*v* is disposed facing the first spring portion 211*v* such that there is formed an insertion space S between the first spring portion 211*v* and the second spring portion 212*v*, into which the male connector terminal 110 of the male electric connector 100 is inserted. The second spring portion 221*v* is designed to have a width almost equal to the same of the first spring portion 211*v*, and has a structure of a flat spring. Specifically, the second spring portion 221*v* downwardly extends from a resilient portion 222*va* located at a top end of the second spring support portion 222*v* to thereby make contact with the other side of the male connector terminal 110.

The joint portion 23*v* is designed to have a width almost equal to the same of the first spring portion 211*v* and the second spring portion 221*v*, and connect a bottom of the first spring portion 211*v* to a bottom of the second spring portion 221*v*.

A step 25*v* is formed over the first spring portion 211*v*, the joint portion 23*v*, and the second spring portion 221*v*. The step 25*v* acts as a limiter for preventing a space between the first spring portion 211*v* and the second spring portion 221*v* from expanding to thereby prevent the first spring portion 211*v*, the joint portion 23*v*, and the second spring portion 221*v* from being deformed.

The step 25*v* is formed by beading to thereby have a recessed surface at one side and a raised surface at the other side. By forming the step 25*v* by beading, two steps each including a raised surface and a recessed surface can be formed in a single step over the first spring portion 211*v*, the joint portion 23*v*, and the second spring portion 221*v*.

The connector portion 20*vb* is in the form of a needle such that it can be readily and fixedly inserted into the printed circuit board P1. The connector portion 20*vb* is connected to a proximal end of the first spring support portion 212*v* of the terminal main body 20*va*.

The engagement portion 26 is connected at a bottom thereof with a bottom of the second spring support portion 222*v*. Specifically, the engagement portion 26 and the second spring support portion 222*v* are U-shaped. The engagement portion 26 is formed in the vicinity of an upper end thereof with a substantially triangular projection 261 which makes engagement with an inner wall step 311*b* (see FIG. 16) formed by thinning a thickness of the partition wall 311 of the terminal storage room R. The projection 261 is formed by pressing, including a step of cutting a bottom thereof.

Figure 15:
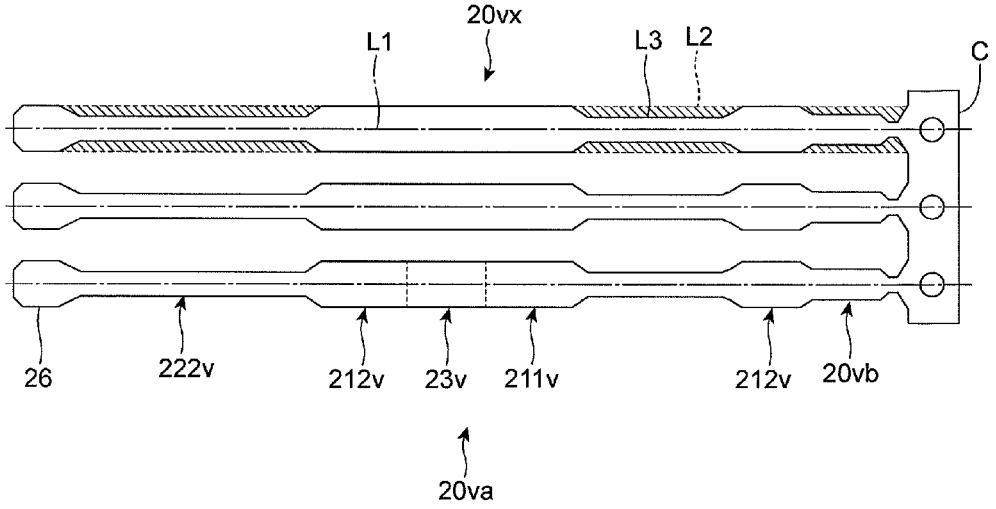
FIG. 15 is a plan view illustrating a carrier and a plurality of the developed connector terminals connected to the carrier.

As illustrated in FIG. 15, the connector terminal 20V is formed by punching a metal plate such that a plurality of connector terminals 20*v*X in a developed condition is aligned in a line along a length-wise direction of a carrier C, and bending each of the developed strip-shaped connector terminal 20*v*X about bending lines intersecting with an axis L1 thereof. Similarly to the connector terminal 20 in accordance with the first embodiment, it is possible to shorten a maximum width of the developed connector terminal 20*v*X, ensuring reduction in a volume of waste metal. Furthermore, since a maximum width of the developed connector terminal 20*v*X can be shortened, it is possible to align a plurality of the developed connector terminals 20*v*X to the carrier C as close as possible. Accordingly, a plurality of the terminal storage rooms R can be aligned in the housing 30 at a small pitch, ensuring that a plurality of the connector terminals 20*v*X can be aligned at a small pitch.

The connector terminal 20*v* in accordance with the second embodiment of the present invention, having the above-mentioned structure, is used as follows.

Figure 16:
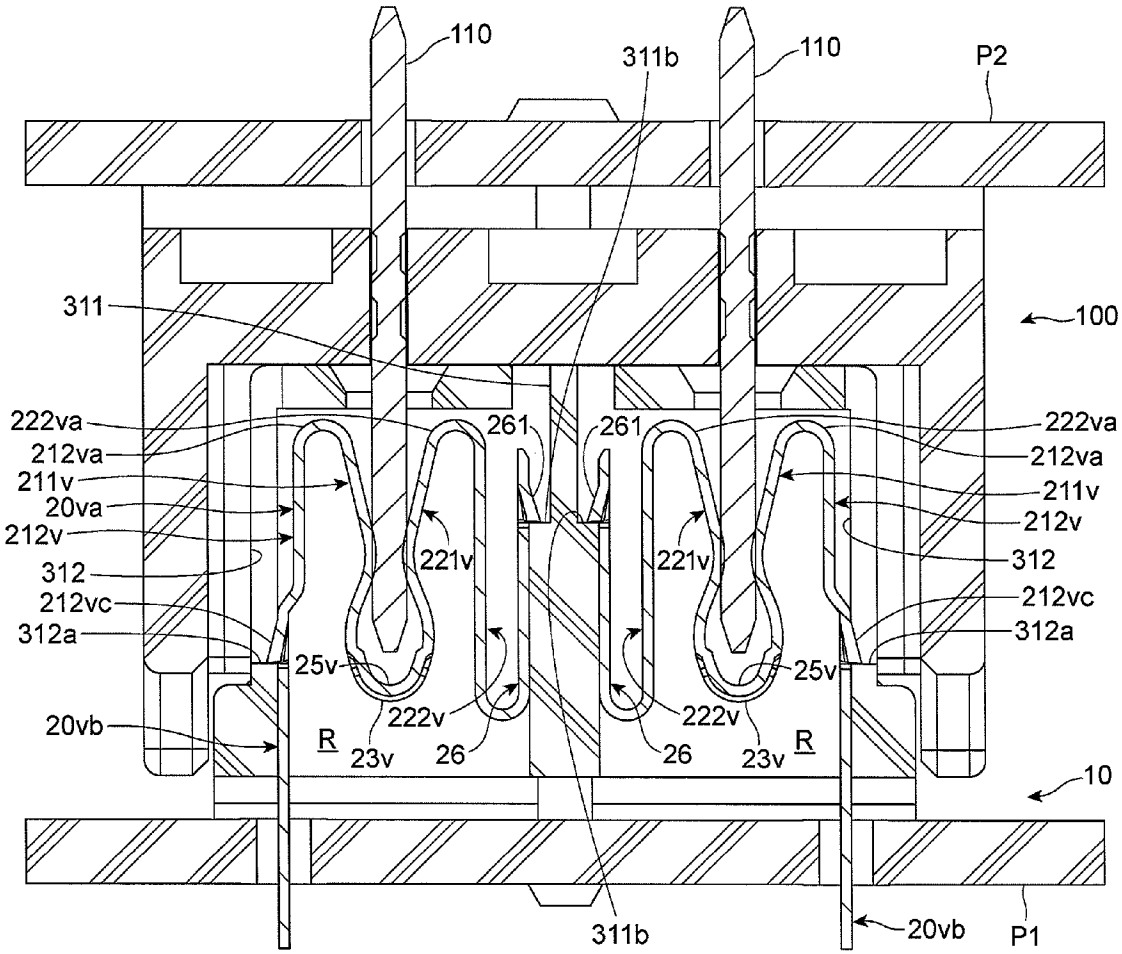
FIG. 16 is a cross-sectional view of a female electric connector into which a male electric connector is inserted.
Figure 17A:
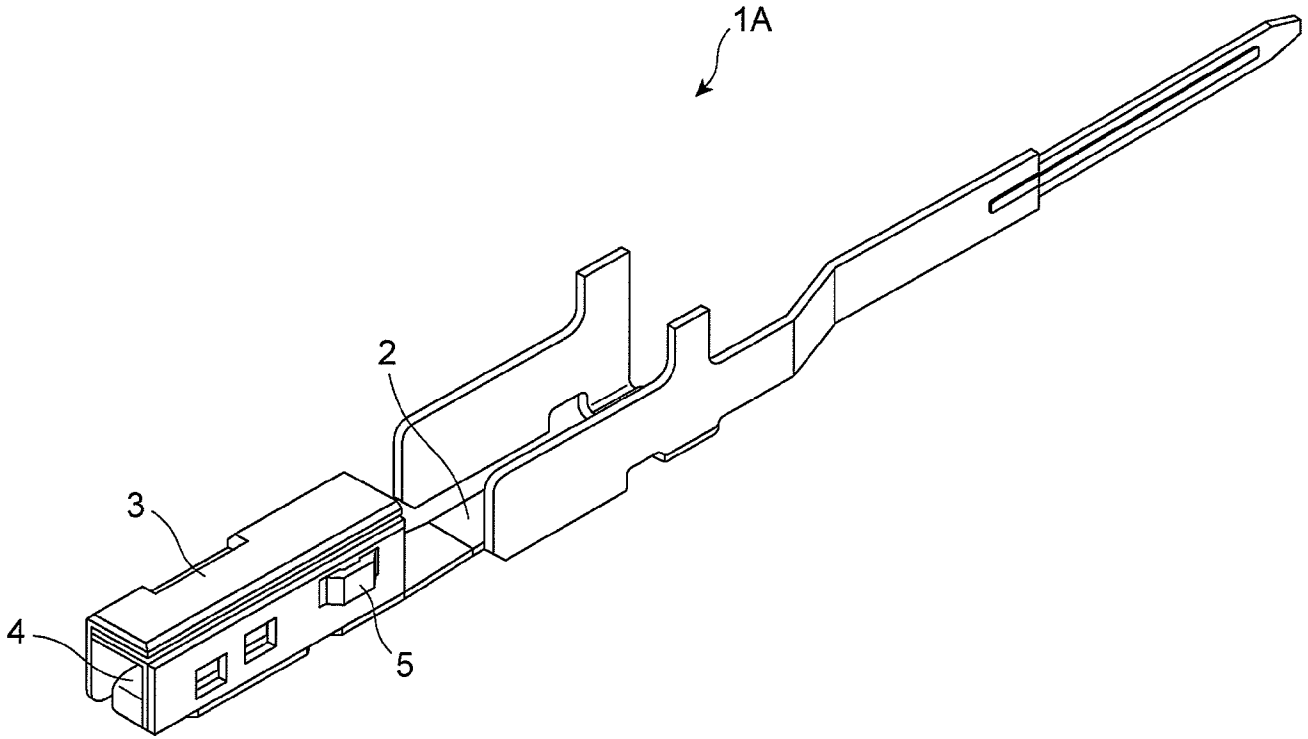
FIG. 17A PRIOR ART
FIG. 17A is a perspective view of the first conventional connector terminal.
Figure 17B:
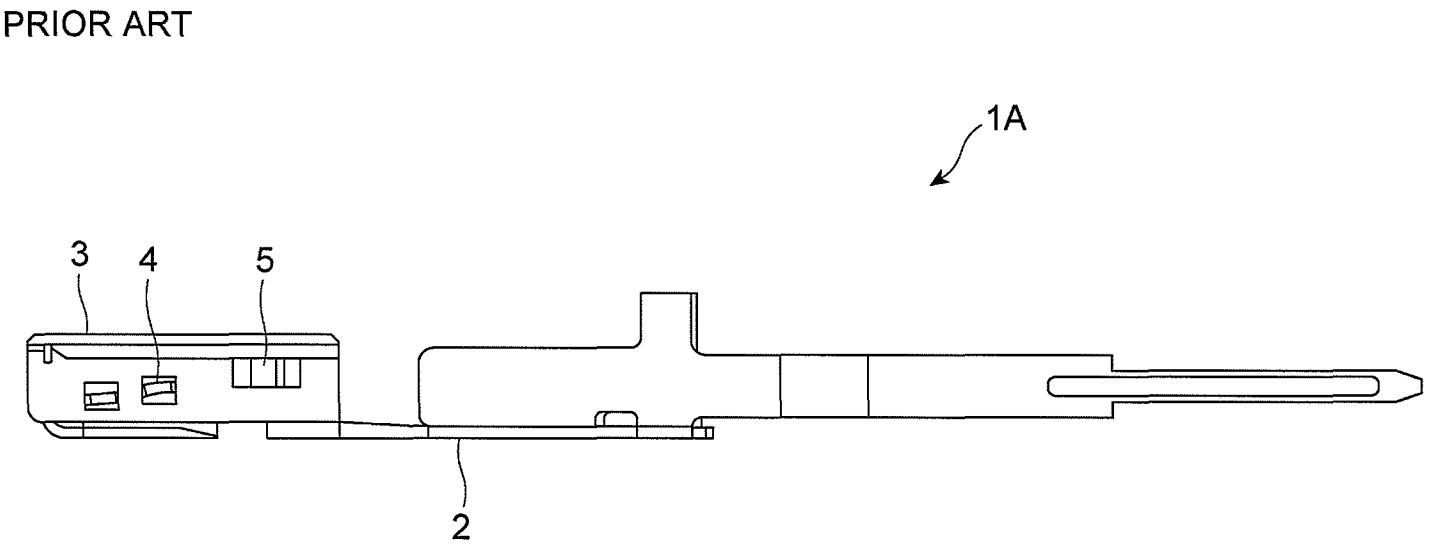
FIG. 17B PRIOR ART
FIG. 17B is a side view of the conventional connector terminal illustrated in FIG. 17A.
Figure 18:
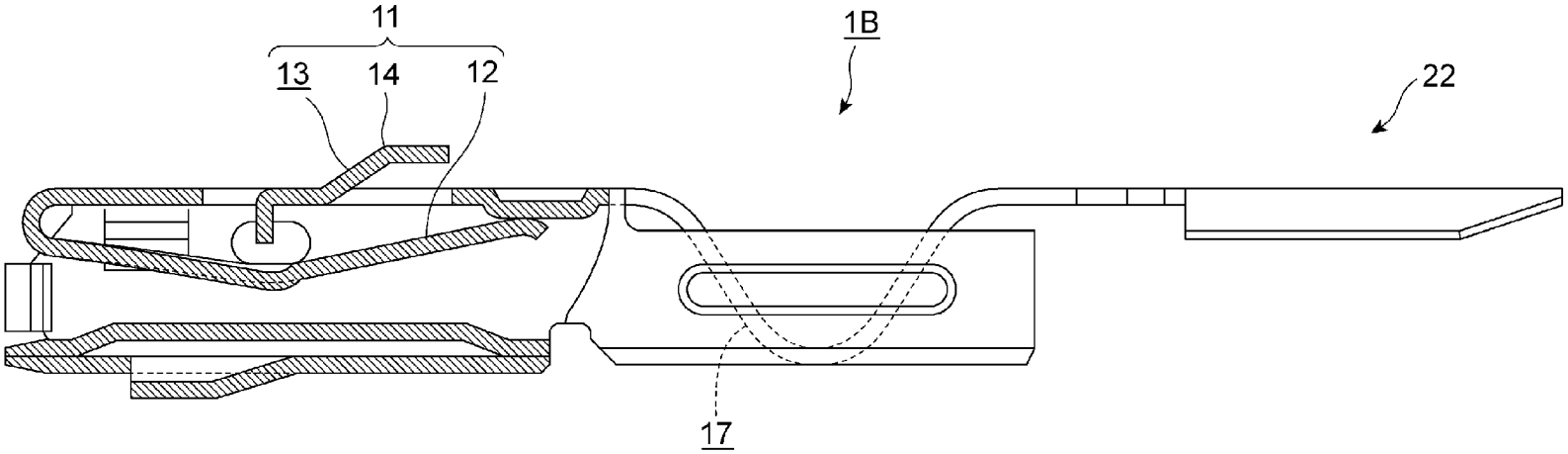
FIG. 18 is a partially cross-sectional view of the second conventional connector terminal.

As illustrated in FIG. 16, the male electric connector 100 and the female electric connectors 10 are coupled to each other. Herein, it is supposed that the male connector terminal 110 is inserted into the connector terminal 20*v* with a positional relation between the printed circuit boards P1 and P2 being deflected, or that after the male connector terminal 110 has been inserted into the connector terminal 20*v*, a positional relation between the printed circuit boards P1 and P2 is deflected due to oscillation, and hence, the male connector terminal 110 now being inserted into the connector terminal 20 oscillates.

For instance, if the male connector terminal 110 deflects towards the first spring portion 211*v*, the first spring portion 211*v* is compressed due to the deflection of the male connector terminal 110. Thus, the first spring portion 211*v* attempts to move away from the second spring portion 221*v*.

However, since the step 25*v* is formed over the first spring portion 211*v*, the joint portion 23*v*, and the second spring portion 221*v* for the purpose of enhancing rigidity of the terminal main body 20*va*, and further since the terminal main body 20*va* is supported by the connector portion 20*vb* and the engagement portion 26, the second spring portion 221*v* is drawn towards the first spring portion 211*v*. Thus, the terminal main body 20*va* moves together with the male connector terminal 110.

For instance, if the male connector terminal 110 deflects towards the second spring portion 221*v*, the second spring portion 221*v* is compressed due to the deflection of the male connector terminal 110. Thus, the second spring portion 221*v* attempts to move away from the first spring portion 211*v*.

However, the first spring portion 211*v* is drawn towards the second spring portion 221*v*, and thus, the terminal main body 20*va* moves together with the male connector terminal 110.

As mentioned above, since the terminal main body 20*va* swings between the resilient portion 212*va* and the engagement portion 26, and hence, the terminal main body 20*va* follows the deflection of the male connector terminal 110, it is possible to prevent the first and second spring terminals 21*v* and 22*v* from outwardly inclining. Thus, it is possible to prevent reduction in a contact pressure which the connector terminal 20*v* exerts on the male connector terminal 110.

Furthermore, since the connector terminal 20*v* is formed by bending the developed connector terminal 20*v*X about bending lines intersecting with the axis L1 of the developed connector terminal 20*v*X, it is possible to reduce a volume of waste metal, and further, to arrange the connector terminals 20*v* at a smaller pitch. Thus, the connector terminal 20*v* in accordance with the second embodiment makes it possible to prevent reduction in a contact pressure between itself and the male connector terminal 110, to be arranged at a smaller pitch, and to simplify a process of assembling the connector terminal 20*v*.

Furthermore, since the step 25*v* is formed closer to the joint portion 23*v* than a location at which the arcuate first and second spring portions 211*v* and 221*v* make contact with the male connector terminal 110, it is possible to design the first and second spring portions 211*v* and 221*v* to have sufficient rigidity, maintaining a contact pressure which the first and second spring portions 211*v* and 221*v* exerts on the male connector terminal 110.

The connector terminals in accordance with the first and second embodiments have been explained above. In the first and second embodiments, the steps 25 and 25*v* are formed by beading within the insertion space S into which the male connector terminal 110 is inserted. As an alternative, the steps 25 and 25*v* may be formed as a rib.

The male and female electric connectors in the first and second embodiments are designed to electrically connect two printed circuit boards to each other, but it should be noted that the male and female electric connectors may be connected to cables or anything else.

INDUSTRIAL APPLICABILITY

The connector terminal in accordance with the present invention can be broadly employed in fields such as electric, electronic and automobile industries, and used in a connector to be used for electric and electronic parts and to be fit into a printed circuit board, or a connector to be mounted in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-193393 filed on Sep. 3, 2012 including specification, claims, drawings and summary is incorporated herein by reference in its entirety.

What is claimed is:

1. A connector terminal comprising:

a first spring terminal;

a second spring terminal, a male connector terminal of a male electric connector to be sandwiched between said first spring terminal and said second spring terminal;

a connector part connecting said first spring terminal and said second spring terminal; and a limiter comprising a step extending along said first spring terminal, said second spring terminal, and said connector part for preventing said first spring terminal, said second spring terminal, and said connector part from being deformed;

wherein said connector terminal is formed by bending a strip-shaped plate about lines intersecting with a longitudinal line of said plate such that a width of said plate is maintained.

2. The connector terminal as set forth in claim 1, wherein said lines are perpendicular to said longitudinal line.

3. The connector terminal as set forth in claim 1, wherein said limiter is integrally formed on said first spring terminal, said second spring terminal, and said connector part.

4. The connector terminal as set forth in claim 1, wherein said first spring terminal includes a first spring portion for contacting said male connector terminal, and a first spring support portion supporting said first spring portion, said second spring terminal includes a second spring portion for contacting said male connector terminal, and a second spring support portion supporting said second spring portion, said connector part connecting a lower end of said first spring portion to a lower end of said second spring support portion, and said step extending from said first spring portion to said second spring support portion through said connector part.

5. The connector terminal as set forth in claim 4, wherein said first spring support portion includes a connector portion adapted to be fixed to a printed circuit board to which said male connector terminal is electrically connected.

6. The connector terminal as set forth in claim 1, wherein said first spring terminal includes a first spring portion for contacting said male connector terminal, and a first spring support portion supporting said first spring portion, said second spring terminal includes a second spring portion for contacting said male connector terminal, and a second spring support portion supporting said second spring portion, said connector part connecting a lower end of said first spring portion to a lower end of said second spring portion, and said step extending from said first spring portion to said second spring portion through said connector part.

7. The connector terminal as set forth in claim 6, wherein said first spring support portion includes a connector portion adapted to be fixed to a printed circuit board to which said male connector terminal is electrically connected, and said second spring support portion includes an engagement portion for engaging a terminal storage room in which said connector terminal is to be housed.

8. The connector terminal as set forth in claim 7, wherein said engagement portion and said second spring support portion are U-shaped.

9. The connector terminal as set forth in claim 8, wherein said engagement portion includes an outwardly extending projection at an outer surface thereof.

* * * * *